US007013618B2

(12) United States Patent
Schiltz et al.

(10) Patent No.: US 7,013,618 B2
(45) Date of Patent: Mar. 21, 2006

(54) COMPARTMENT PLATES HAVING THEMES AND METHOD FOR MANUFACTURING AND PACKAGING THE SAME

(75) Inventors: David C. Schiltz, Columbus, OH (US); Christina M. Tranfaglia, Glenview, IL (US); Jeffrey L. Roberts, Round Lake Park, IL (US); Edward J. Seeberger, Dublin, OH (US); Brad W. Dickason, Hilliard, OH (US)

(73) Assignee: Pactiv Corporation, Lake Forest, IL (US)

( * ) Notice: Subject to any disclaimer, the term of this patent is extended or adjusted under 35 U.S.C. 154(b) by 0 days.

(21) Appl. No.: 10/251,745

(22) Filed: Sep. 19, 2002

(65) Prior Publication Data

US 2003/0046903 A1 Mar. 13, 2003

Related U.S. Application Data

(63) Continuation-in-part of application No. 29/141,202, filed on May 1, 2001, now Pat. No. Des. 468,589.

(51) Int. Cl.
*B65B 21/06* (2006.01)

(52) U.S. Cl. ..... 53/411; 53/443; 53/447

(58) Field of Classification Search ..... 53/447, 53/443, 411, 168, 542, 254, 540
See application file for complete search history.

(56) References Cited

U.S. PATENT DOCUMENTS

| | | | | |
|---|---|---|---|---|
| 292,651 | A | 1/1884 | Hentschke | |
| D30,561 | S | 4/1899 | Schubert | |
| D38,680 | S | 7/1907 | Brereton | |
| 876,808 | A | 1/1908 | Kinert | |
| D45,367 | S | 3/1914 | Bentz | |
| 1,502,402 | A | 12/1924 | Clemans | |
| D70,480 | S | 6/1926 | Kopel | |
| 1,644,612 | A | 10/1927 | Roberts | |
| D89,791 | S | 5/1933 | Pittman | D7/555 |
| D91,229 | S | 12/1933 | Pyle | |
| 2,096,825 | A | 10/1937 | Roman | 206/47 |
| D106,782 | S | 11/1937 | De Benque | |
| D145,718 | S | 10/1946 | Geddes | |
| D148,419 | S | 1/1948 | Jacobsen | D44/10 |

(Continued)

FOREIGN PATENT DOCUMENTS

| | | |
|---|---|---|
| CA | 24250 | 8/1961 |

(Continued)

OTHER PUBLICATIONS

Lucky Charms box front and back, purchased by Examiner on Jul. 21, 2004 and entered into the record on Jul. 22, 2004, the date of this Office Action.*

(Continued)

*Primary Examiner*—Louis K. Huynh
*Assistant Examiner*—John Paradiso
(74) *Attorney, Agent, or Firm*—Winston & Strawn LLP

(57) ABSTRACT

According to another embodiment of the present invention, a method of packaging an arrangement of plates is disclosed. The method of packaging an arrangement of plates comprises providing a plurality of plates that have a depiction associated with a common theme, selecting from the plurality of plates to form a first group of plates and a second group of plates, and packaging the first and second group of plates for commercial distribution. The plurality of plates including a number of different depictions, and the second group of plates containing plates with different depictions than the first group of plates.

41 Claims, 18 Drawing Sheets

U.S. PATENT DOCUMENTS

| | | | | |
|---|---|---|---|---|
| D150,666 | S | 8/1948 | Zachary | D44/14 |
| 2,738,915 | A | 3/1956 | St. Clair | 229/2.5 |
| D185,873 | S | 11/1959 | Bergeron | D44/15 |
| 3,051,346 | A | 8/1962 | Grogel | 220/23.8 |
| D194,155 | S | 11/1962 | Gottsegen | D44/10 |
| D195,602 | S | 7/1963 | Bostrom | D58/11 |
| D199,991 | S | 1/1965 | McManamey | D44/10 |
| D212,196 | S | 9/1968 | Pasquale | D44/29 |
| 3,401,863 | A | 9/1968 | Earl | 229/2.5 |
| D218,927 | S | 10/1970 | Artz | D9/4 |
| D220,749 | S | 5/1971 | Artz | D9/4 |
| 3,633,785 | A | 1/1972 | Cyr et al. | 220/20 |
| D223,144 | S | 3/1972 | Bloch | D9/3 |
| D224,206 | S | 7/1972 | Cyr et al. | |
| 3,675,811 | A | 7/1972 | Artz | 220/20 |
| 3,708,086 | A | 1/1973 | Colato | 220/20 |
| D233,501 | S | 11/1974 | Zeischegg | D7/10 |
| D235,498 | S | 6/1975 | Day | D7/99 |
| D235,499 | S | 6/1975 | Day | D7/99 |
| 4,081,646 | A | 3/1978 | Goltsos | 219/10.55 |
| D251,102 | S | 2/1979 | Box | D7/38 |
| D255,968 | S | 7/1980 | Shack | D7/38 |
| D258,632 | S | 3/1981 | Commisso | D7/38 |
| 4,298,133 | A | 11/1981 | Davis | 220/306 |
| D263,023 | S | 2/1982 | Commisso | D9/3 |
| D268,645 | S | 4/1983 | Phillips et al. | D9/3 |
| D274,971 | S | 8/1984 | Kelley et al. | D7/144 |
| D280,060 | S | 8/1985 | Holzkopf | D7/38 |
| D283,666 | S | 5/1986 | Holzkopf | D7/38 |
| 4,653,685 | A | 3/1987 | Leary et al. | 229/2.5 |
| 4,778,055 | A * | 10/1988 | Kiedaisch | 206/563 |
| 4,847,459 | A | 7/1989 | Desai | 219/10.55 |
| D305,192 | S | 12/1989 | van Erkel | D7/1 |
| D305,409 | S | 1/1990 | Michaud et al. | D9/425 |
| D309,684 | S | 8/1990 | Kohler | D6/511 |
| 5,004,121 | A | 4/1991 | Howe | 220/458 |
| 5,094,355 | A | 3/1992 | Clark et al. | 220/4.23 |
| D331,860 | S | 12/1992 | Stanfield | D7/549 |
| 5,236,119 | A | 8/1993 | Chu | 229/2.5 |
| D341,750 | S | 11/1993 | Scicolone | D7/546 |
| 5,322,182 | A | 6/1994 | Fritz | 220/623 |
| D349,456 | S | 8/1994 | Wilson | D9/347 |
| 5,335,787 | A | 8/1994 | Finchum et al. | 206/564 |
| D352,203 | S | 11/1994 | Campbell et al. | D7/553 |
| 5,375,701 | A | 12/1994 | Hustad et al. | 206/45.18 |
| D375,484 | S | 11/1996 | Leifer | D14/114 |
| 5,657,873 | A | 8/1997 | Hustad et al. | 206/764 |
| 5,657,974 | A | 8/1997 | Williams | 269/93 |
| 5,695,798 | A | 12/1997 | Rozzano | 426/115 |
| 5,697,512 | A | 12/1997 | Brickley | 220/23.8 |
| D388,699 | S | 1/1998 | Hayes et al. | D9/341 |
| 5,730,313 | A | 3/1998 | Hayes et al. | 220/526 |
| 5,762,231 | A | 6/1998 | Rider, Jr. et al. | 220/526 |
| D395,983 | S | 7/1998 | Panta Chica | D7/553 |
| 5,878,908 | A | 3/1999 | Foley | 220/575 |
| D410,820 | S | 6/1999 | Lofrano | D7/553.8 |
| D426,747 | S | 6/2000 | Suero, Jr. et al. | D7/401 |
| 6,098,831 | A | 8/2000 | Dibble | 220/574 |
| 6,186,394 | B1 | 2/2001 | Dees et al. | 229/122.34 |
| 6,363,568 | B1 | 4/2002 | Harrison et al. | 15/167.1 |
| 6,364,203 | B1 | 4/2002 | Toussant et al. | 229/407 |
| 6,367,649 | B1 | 4/2002 | Balakumar | 220/575 |
| 6,463,713 | B1 * | 10/2002 | Ruemeli | 53/52 |
| D470,366 | S | 2/2003 | Ralph | D7/642 |
| 2003/0066776 | A1 | 4/2003 | Schlitz et al. | 206/445 |
| 2003/0070956 | A1 | 4/2003 | Schiltz et al. | 206/515 |

FOREIGN PATENT DOCUMENTS

| | | |
|---|---|---|
| CA | 29984 | 11/1967 |
| CA | 790950 | 7/1968 |
| CA | 32706 | 7/1970 |
| CA | 32707 | 7/1970 |
| CA | 43553 | 5/1978 |
| CA | 45022 | 2/1979 |
| CA | 45077 | 3/1979 |
| CA | 51419 | 5/1983 |
| CA | 57764 | 12/1986 |
| CA | 1 222 978 | 6/1987 |
| CA | 1 225 342 | 8/1987 |
| CA | 2 067 604 | 3/1993 |
| CA | 2 199 706 | 4/1996 |
| CA | 2 105 212 | 4/1997 |
| CA | 83910 | 5/1998 |
| CA | 2245216 | 2/1999 |
| CA | 2 077 636 | 11/1999 |
| CA | 2 328 709 | 5/2000 |
| CA | 2 311 860 | 12/2000 |
| CA | 2 313 181 | 1/2001 |
| CA | 2 313 183 | 1/2001 |
| CA | 2 313 593 | 1/2001 |
| CA | 2 232 341 | 4/2001 |
| CA | 2 317 313 | 3/2002 |
| GB | 2044226 | 10/1980 |
| GB | 2078095 | 1/1982 |
| GB | 2 163 730 A | 3/1986 |
| GB | 2 203 130 A | 10/1988 |
| GB | 2 205 064 A | 11/1988 |
| GB | 2 219 271 A | 12/1989 |
| GB | 2 259 640 A | 3/1993 |
| GB | 2 271 983 A | 5/1994 |
| GB | 2 276 531 A | 10/1994 |
| GB | 2 290 741 | 1/1996 |
| GB | 2 285 406 B | 7/1997 |
| GB | 2 324 707 A | 11/1998 |
| GB | 2 331 290 A | 5/1999 |
| MX | 5624 | 10/1992 |

OTHER PUBLICATIONS

Bison Designs Alien Bottle Opener Keychain, http://www.rei.com, Aug. 20, 2003, 2 pgs.

Bison Designs Fighter Fish Bottle-Opener Keychain, http://www.rei.com, Aug. 20, 2003, 2 pgs.

Bison Designs Foot Bottle-Opener Keychain, http://www.rei.com, Aug. 20, 2003, 2 pgs.

Bison Designs Gecko Bottle-Opener Keychain, http://www.rei.com, Aug. 20, 2003, 2 pgs.

Bison Designs Kokopelli Bottle-Opener Keychain, http://www.rei.com, Aug. 20, 2003, 2 pgs.

Bison Designs Mini Fish Carabiner Keychain, http://www.rei.com, Aug. 20, 2003, 2 pgs.

Bison Designs Paw Print Bottle-Opener Keychain, http://www.rei.com, Aug. 20, 2003, 2 pgs.

Bison Designs Trout Bottle-Opener Keychain, http://www.rei.com, Aug. 20, 2003, 1 pg.

Picture of Plastic Knife, Spoon and Fork, Flatware , Mervyn's Brands, Inc. © 2002, 2 pgs.

Design #1008240 Bibliography, Registration date Aug. 11, 1982, The Patent Office website, 8 pages.

Design #1054077 Bibliography, Registration date Oct. 6, 1988, The Patent Office website, 7 pages.

Design #2079134 Bibliography, Registration date Nov. 13, 1998, The Patent Office website, 7 pages.

Pactiv Corporation Product Information Brochure Hefty® Zoo Pals™ Pre-Packed Shelf Display (2001) 1 page.

Pactiv Corporation 2002 Promotion Support Plans Information Brochure Hefty® Zoo Pals™ Assorted Animal Plates (2001) 6 pages.
Pactiv corporation Product Information Brochure Hefty® Zoo Pals™ Assorted Animal Plates (2001) 2 pages.
Krazy Kritters Website: http://www.gp.com/krazykritters (2002) 124 pages.
Hefty Zoo Pals™ Website: http://www.heftyzoopals.com (undated) 116 pages.

* cited by examiner

COMPARTMENT PLATES HAVING THEMES AND METHOD FOR MANUFACTURING AND PACKAGING THE SAME

CROSS-REFERENCE TO RELATED APPLICATIONS

The present application is a continuation-in-part of copending U.S. Design patent application Ser. No. 29/141,202, entitled "Plate Having Condiment Wells," which was filed on May 1, 2001, and is incorporated herein by reference in its entirety.

FIELD OF THE INVENTION

The present invention generally relates to food or beverage containing devices and, more particularly, to the arrangement and manufacture of compartment plates having themes.

BACKGROUND OF THE INVENTION

Plates having compartments are used for holding food. Often, a main compartment is designed to hold a main dish whereas the other compartment, or wells, are used to hold sides, condiments, or both. Prior art disposable plates have had various designs or patterns printed thereon, but do not integrate the various compartments into the printed design or pattern.

Additionally, prior art designs or patterns printed on disposable plates focused on a small number of designs The number of designs per collection in the prior art has been less than the total number of plates packaged together for retail sale. Thus, each retail package of plates includes only a complete collection of designs. The prior art does not address the situation where the number of designs per collection exceeds the total number of plates in a retail package and how to widely disseminate all of the designs in the collection in the market place.

SUMMARY OF THE INVENTION

According to one embodiment of the present invention, an arrangement of plates for receiving food is disclosed. The arrangement of plates comprises a plurality of nestable plates, wherein the plates within the plurality of nestable plates have an animal theme Each of the plates having an animal theme include a main compartment depicting a primary attribute of an animal corresponding to the animal theme, and at least two independent wells adjacent to the main compartment. Each of the wells are shaped to depict a secondary attribute of the animal corresponding to the animal theme. The plurality of plates include a first plate depicting a first animal and a second plate depicting a second animal that is different from the first animal. The secondary attribute within the wells of said first plate is a first physical feature of the first animal and the secondary attribute within the wells of the second plate is a second physical feature of the second animal. The first physical feature is different from the second physical feature while the wells of the first and second plates are similarly shaped allowing the plurality of plates to be nestable.

According to another embodiment of the present invention, a method of packaging an arrangement of plates is disclosed. The method of packaging an arrangement of plates comprises providing a plurality of plates that have a depiction associated with a common theme, selecting from the plurality of plates to form a first group of plates and a second group of plates, and packaging the first and second group of plates for commercial distribution. The plurality of plates including a number of different depictions, and the second group of plates containing plates with different depictions than the first group of plates.

According to yet another embodiment of the present invention a case of plate packages is disclosed. The case of plate packages comprises a plurality of plate packages and a covering structure surrounding said plurality of plate packages. Each of the plate package includes a plurality of nestable plates and a transparent wrapping for enveloping the plurality of nestable plates. The plates within the plurality of nestable plates include different depictions associated with a common theme. Each of the plurality of nestable plates include a top plate that is at least partially visualized through said transparent wrapping. The top plates for the plurality of plate packages include plates with different depictions.

The arrangements of plates having themes, the methods for packaging plates having themes, and the cases of plates having themes according to the above-summarized embodiments of the present invention, as well as those set-forth in the following description, have enjoyed wide-spread commercial success in the retail marketplace due to the variety and collectability of the theme plates in a package. In particular, the Assignee of the present invention has experienced substantially commercial success in the last several months selling plates corresponding to an animal theme under its ZOO PALS trademark. Currently, plates being sold under the ZOO PALS trademark include fifty-one different animal depictions corresponding to a common animal theme, and are commercially available in packages of twenty-four (24) plates, wherein each package of twenty-four plates includes approximately eight (8) different animal depictions. The ZOO PALS™ plates include a main compartment depicting a primary attribute of a particular animal corresponding to the animal theme and two independent wells adjacent to the main compartment, each located and shaped to depict a secondary attribute of that particular animal. Cases containing several independently wrapped ZOO PALS™ plate packages have contributed to the commercial success by providing a substantial variety of animals in the plate packages of each case received by a certain retail customer, including the use of different animals on the top plates of the plate packages which can be visually recognized by consumers.

The above summary of the present invention is not intended to represent each embodiment, or every aspect, of the present invention. Additional features and benefits of the present invention will become apparent from the detailed description, figures, and claims set forth below.

Figure 1A:
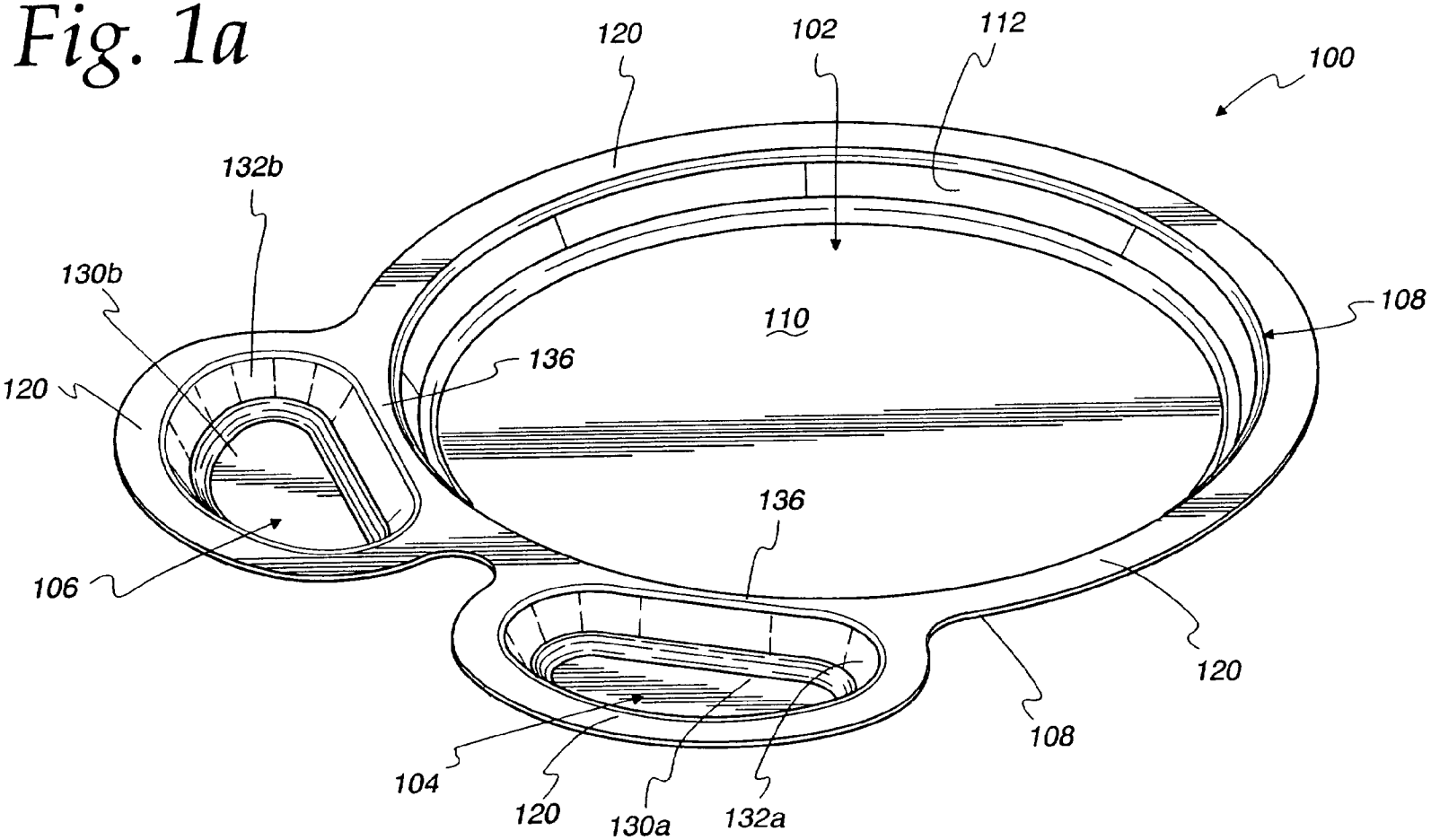
FIG. 1*a* is a perspective view of a plate having condiment wells according to one embodiment of the present invention.

While the invention is susceptible to various modifications and alternative forms, specific embodiments will be shown by way of example in the drawings and will be described in detail herein. It should be understood, however, that the invention is not intended to be limited to the particular forms disclosed. Rather, the invention is to cover all modifications, equivalents and alternatives falling within the spirit and scope of the invention as defined by the appended claims.

DETAILED DESCRIPTION OF THE ILLUSTRATED EMBODIMENTS

Turning to the drawings, and initially to FIGS. 1*a–g*, there is shown a plate 100 having multiple compartments according to one embodiment of the present invention. The plate 100 is constructed of paper, plastic, or other suitable material for holding food. The depicted plate 100 includes a main compartment 102 and two additional compartments, also referred to as wells 104 and 106, disposed along an outer periphery 108 of the main compartment of the plate 100.

The main compartment 102 includes a bottom wall 110 and a side wall 112 that extends around the bottom wall 110 and is generally circular in shape, but it can take on a variety of shapes (e.g., rectangular, hexagonal, square, octagonal, triangular) and sizes according to alternatives of the present invention. As is perhaps seen best in FIG. 1*h*, the edges of the side wall 112 intersect the bottom wall 110 in a rounded fashion to form a rounded edge 114. The side wall 112 upwardly and outwardly extends from the bottom wall 110. At a top end of the side wall 112, the side wall 112 curves outwardly away from the main compartment 100 and forms a flange 120 around the main compartment 100. There is a rounded transition 122 between the flange 120 and the side wall 112.

When the plate 100 is used for containing foods, the main compartment is typically used for holding food such as the main dish and sides and the wells 104, 106 are often used to hold condiments. For example, where the main dish and sides include chicken nuggets and French fried potatoes, the condiment wells 104, 106 may be used to hold barbecue sauce and ketchup. Alternatively, the wells 104, 106 may hold other side dishes such as, for example, potato salad, fruit salad, coleslaw, raisins, cheese cubes, applesauce, or a combination thereof. Of course, there are a myriad of ways in which a user may choose to use the main compartments 100 and the wells 104, 106 beyond the afore-described examples.

Disposed at one end of the circular main compartment 112 are two generally lobular-shaped wells 102, 104. The condiment wells are disposed in close proximity relative to one another in the illustrated embodiments—the midpoints of the two wells 104, 106 are located around the periphery of the main compartment 102 such that an angle between the midpoints of the wells measured from a midpoint of the main compartment is less than about 90°. The condiment wells 104, 106 can, however, be disposed in a variety of positions in an alternative embodiment of the present invention as is later discussed in connection with FIGS. 4*a–e*. For example, in other alternative embodiments, the midpoints of the two wells 104, 106 are located around the periphery of the main compartment 102 such that an angle between the midpoints of the wells measured from a midpoint of the main compartment is less than about 180°.In the embodiment depicted in FIGS. 1*a–h*, the condiment wells 104, 106 are somewhat rounded in shaped. Like the main compartment 102, the condiment wells 104, 106 includes bottom walls 130*a*, 130*b* and sloped side walls 132*a*, 132*b*. The flange 120 that extends around the main compartment 102 continues around the condiment wells 104, 106. A narrower flange 136 connects the condiment wells 102, 104 to the main compartment 102.

Figure 1B:
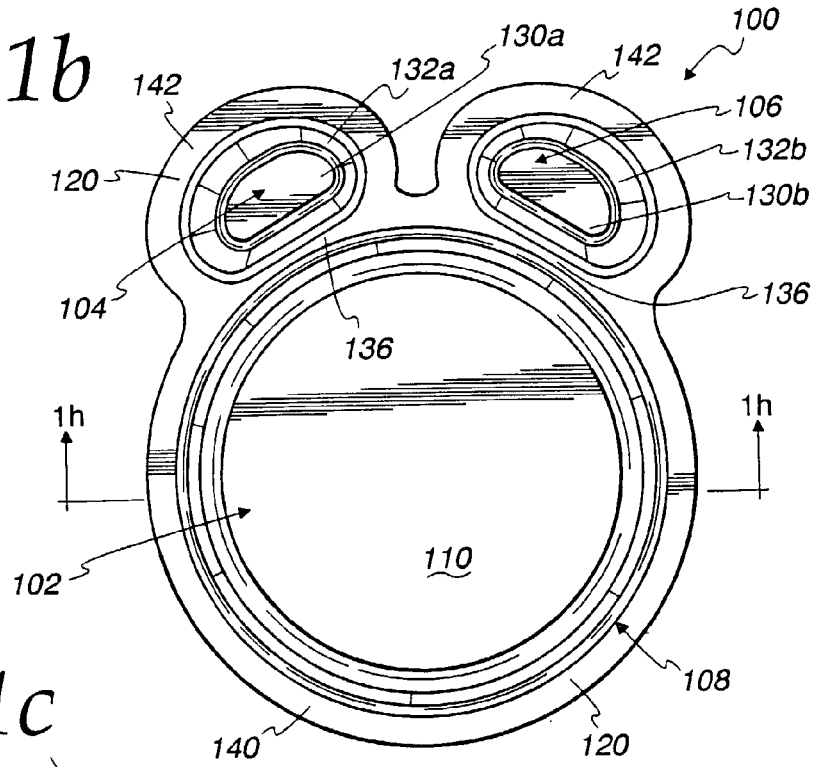
FIG. 1*b* is a top view of the plate having wells of FIG. 1*a*
Figure 1C:
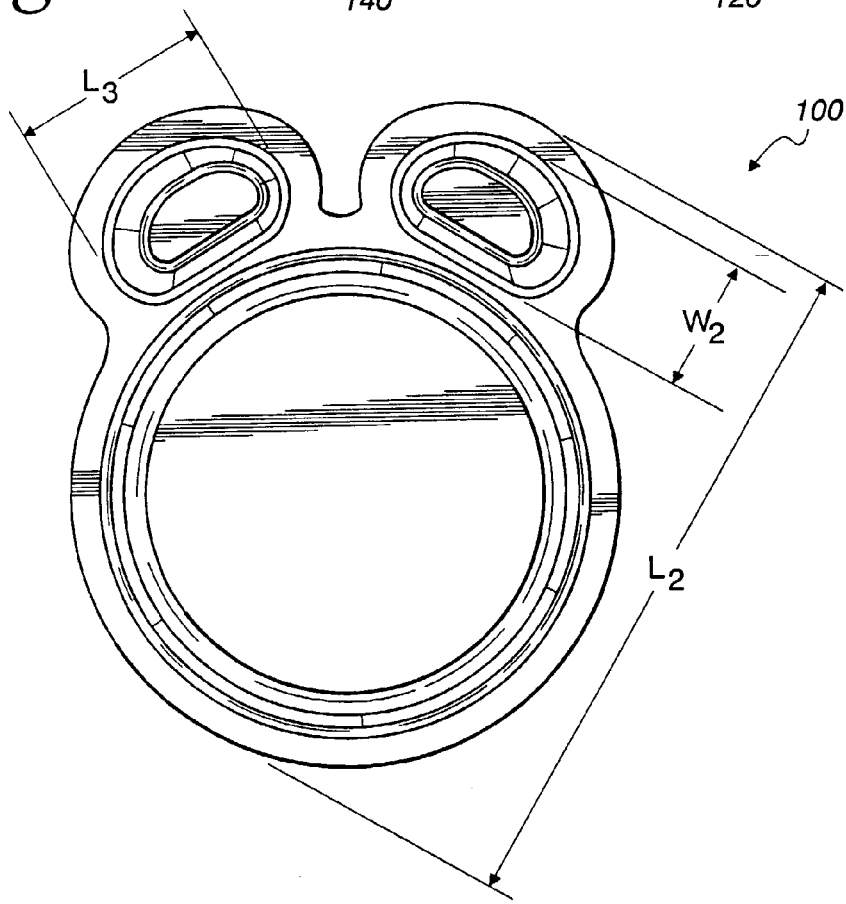
FIG. 1*c* is a bottom view of the plate having wells of FIG. 1*a*.
Figure 1D:
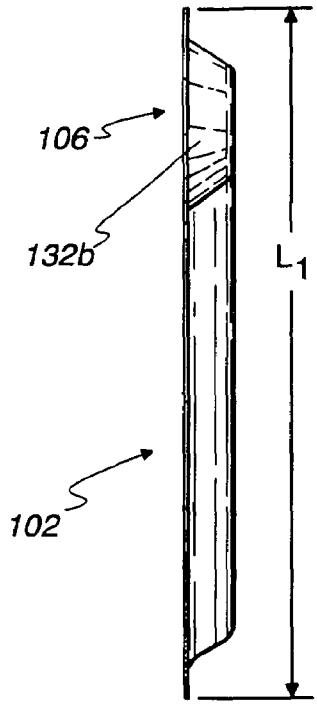
FIG. 1*d* is a right side view of the plate having wells of FIG. 1*a*.
Figure 1E:
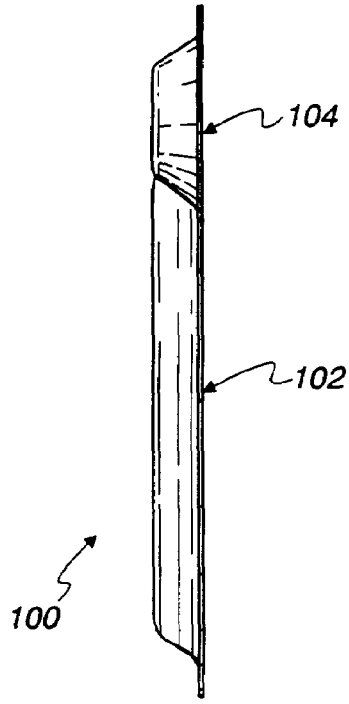
FIG. 1*e* is a left side view of the plate having wells of FIG. 1*a*.
Figure 1F:
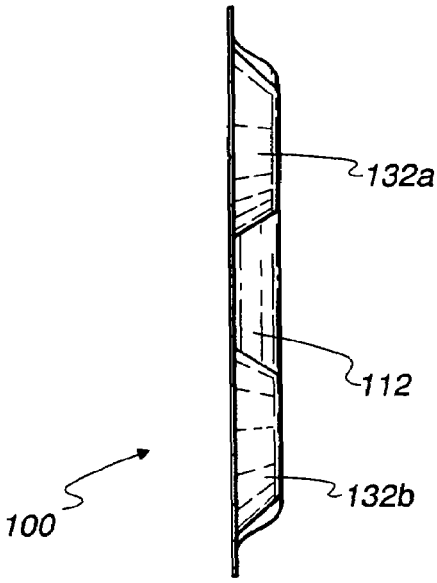
FIG. 1*f* is a back side view of the plate having wells of FIG. 1*a*.
Figure 1G:
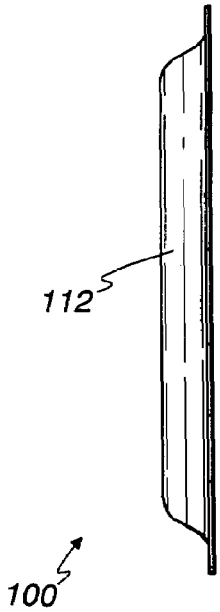
FIG. 1*g* is a front side view of the plate having wells of FIG. 1*a*.
Figure 2A:
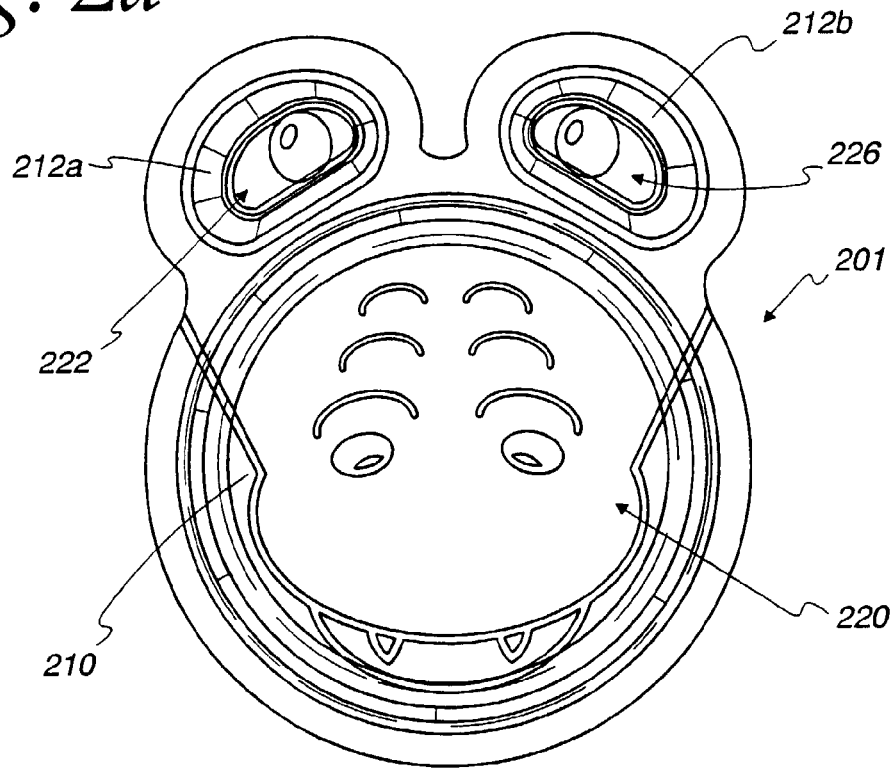
FIG. 2*a* is a top view of a plate having wells with an alligator depiction thereon according to one embodiment of the present invention.
Figure 2B:
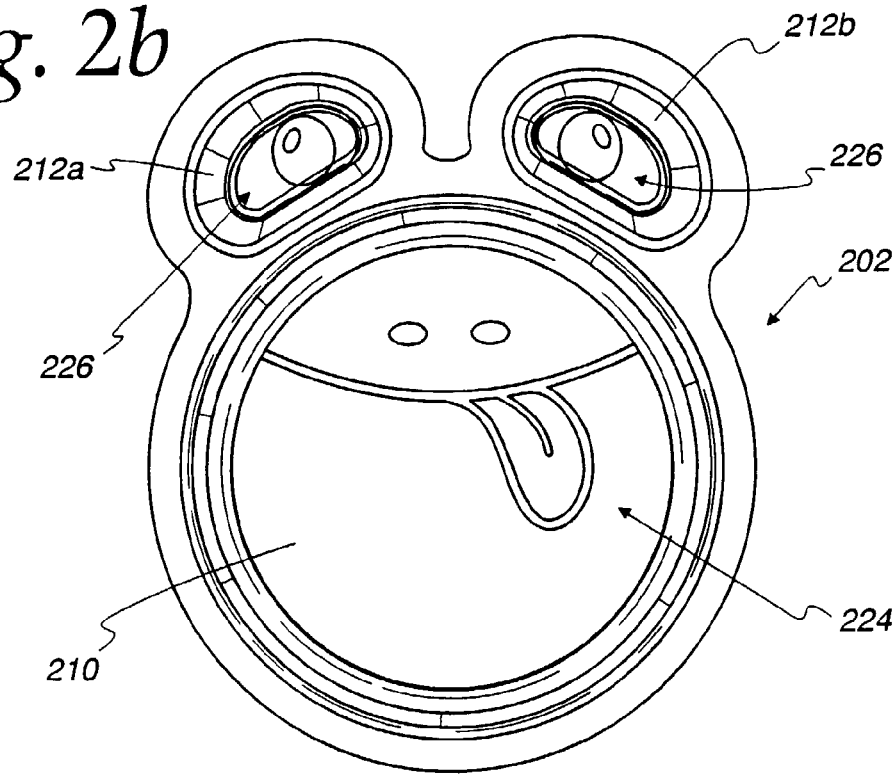
FIG. 2*b* is a top view of a plate having wells with a frog depiction thereon according to one embodiment of the present invention
Figure 2C:
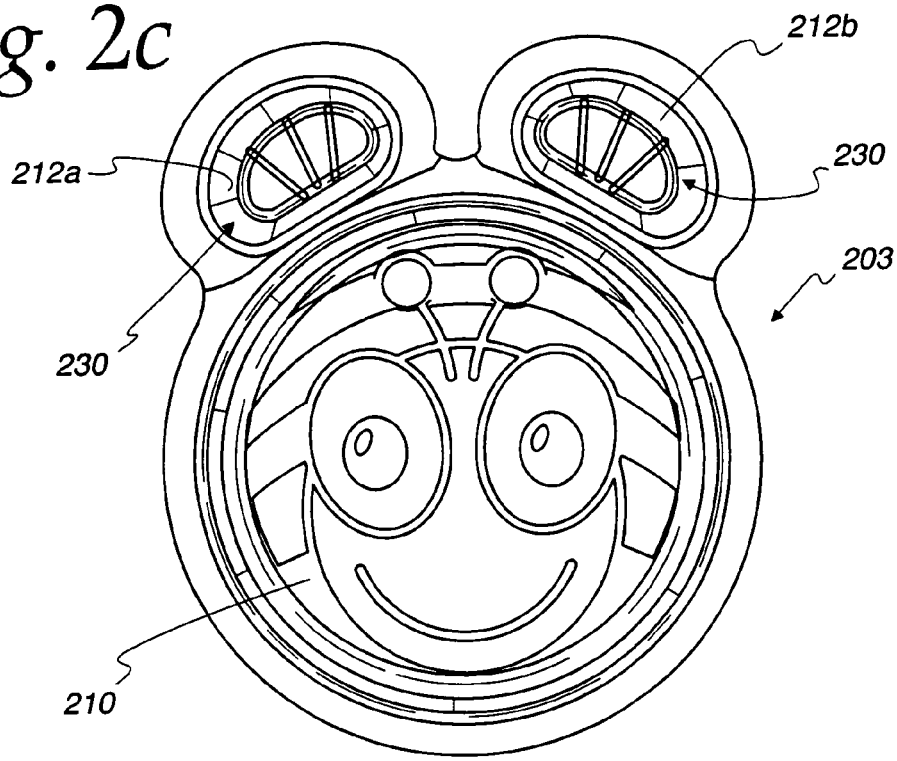
FIG. 2*c* is a top view of a plate having wells with a bumblebee depiction thereon according to one embodiment of the present invention
Figure 2D:
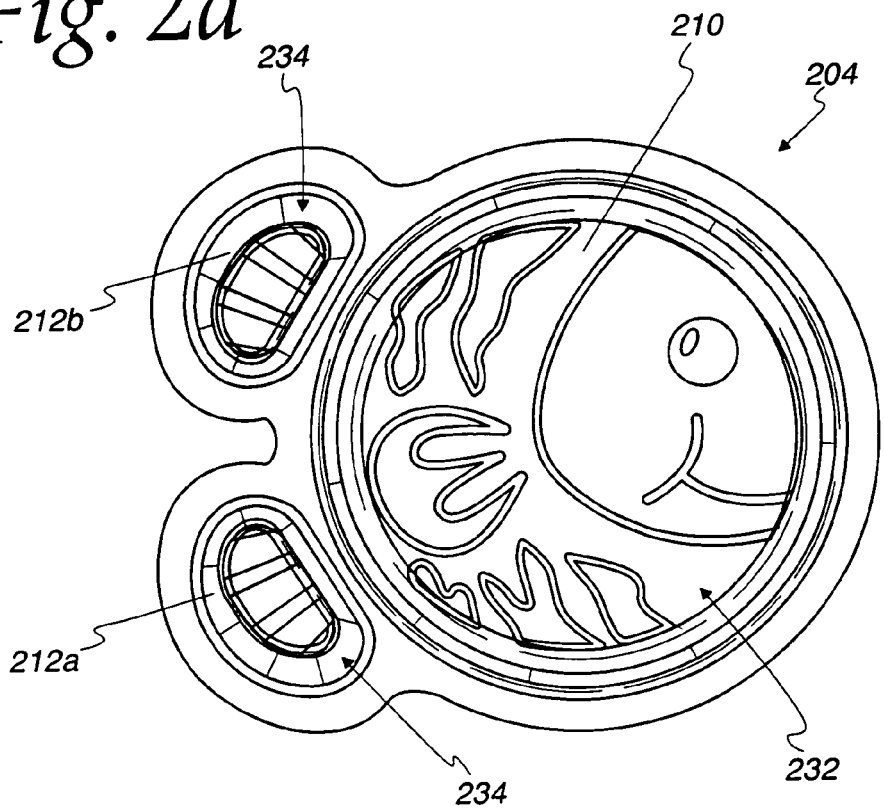
FIG. 2*d* is a top view of a plate having wells with a fish depiction thereon according to one embodiment of the present invention.
Figure 2E:
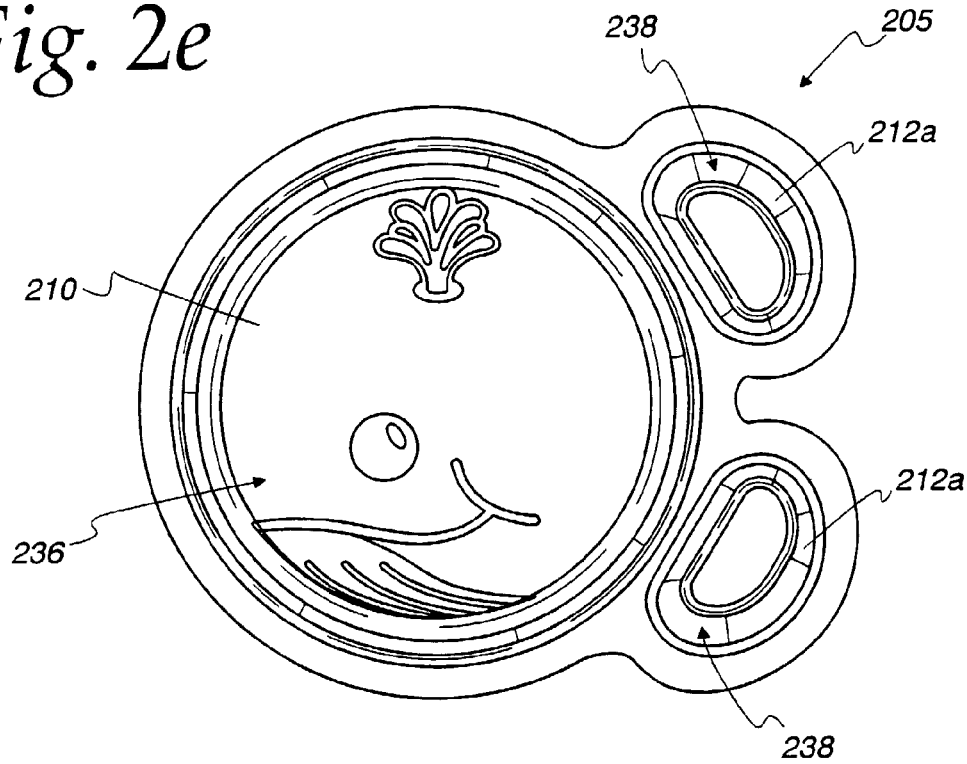
FIG. 2*e* is a top view of a plate having wells with a whale depiction thereon according to one embodiment of the present invention.
Figure 2F:
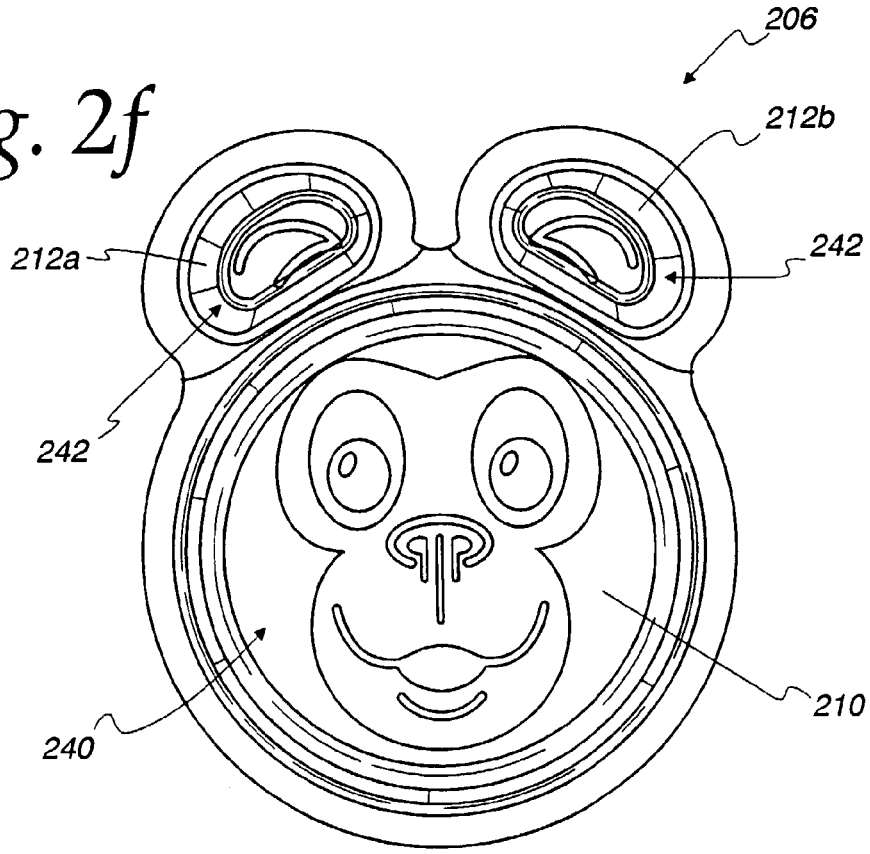
FIG. 2*f* is a top view of a plate having wells with a monkey depiction thereon according to one embodiment of the present invention.
Figure 2G:
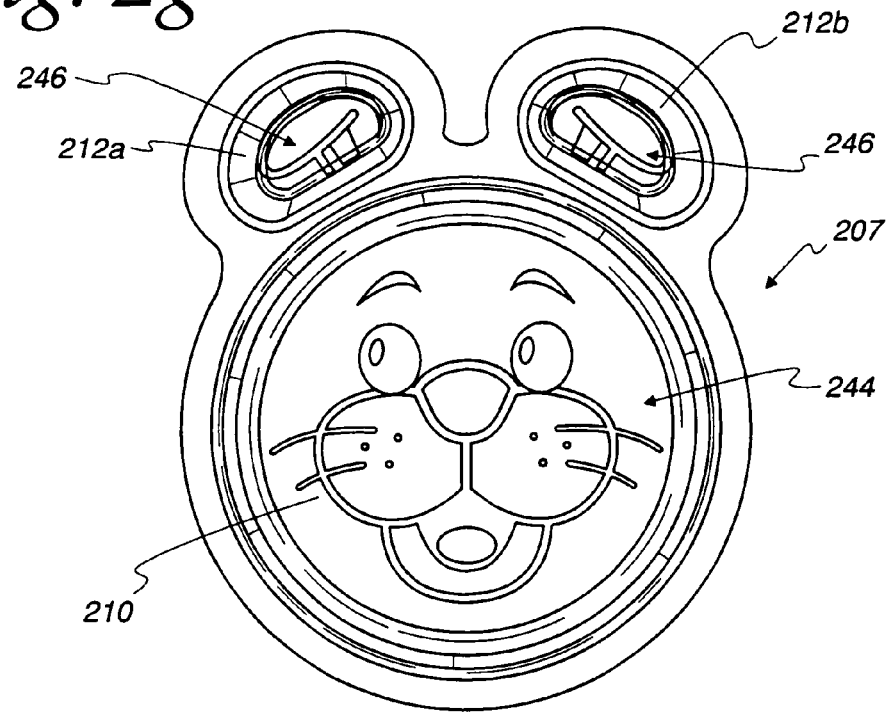
FIG. 2*g* is a top view of a plate having wells with a bunny depiction thereon according to one embodiment of the present invention.
Figure 2H:
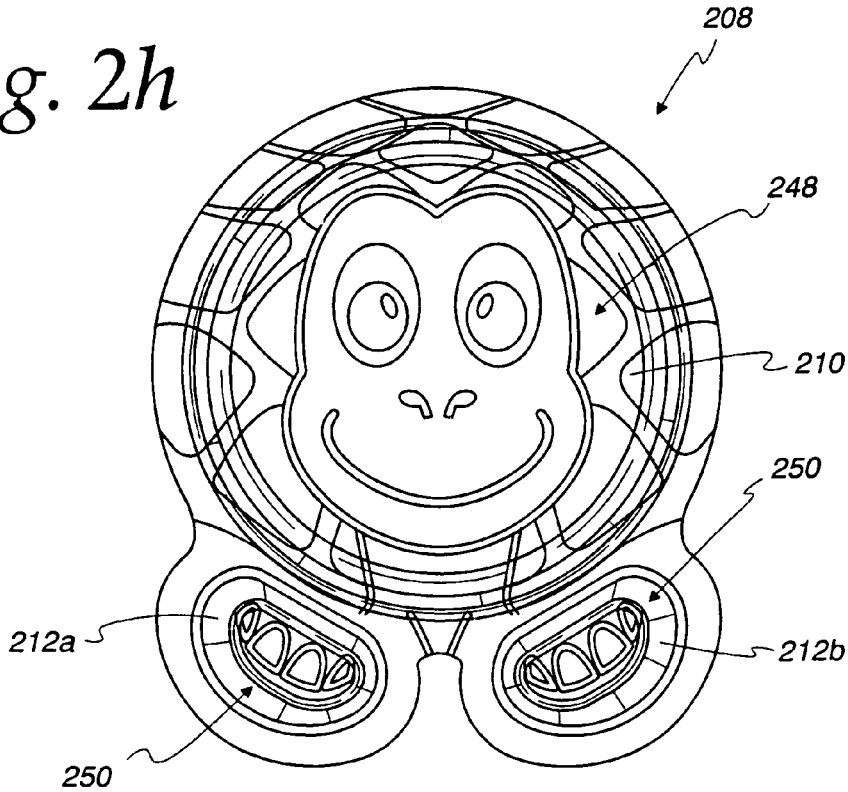
FIG. 2*h* is a top view of a plate having wells with a turtle depiction thereon according to one embodiment of the present invention.
Figure 2I:
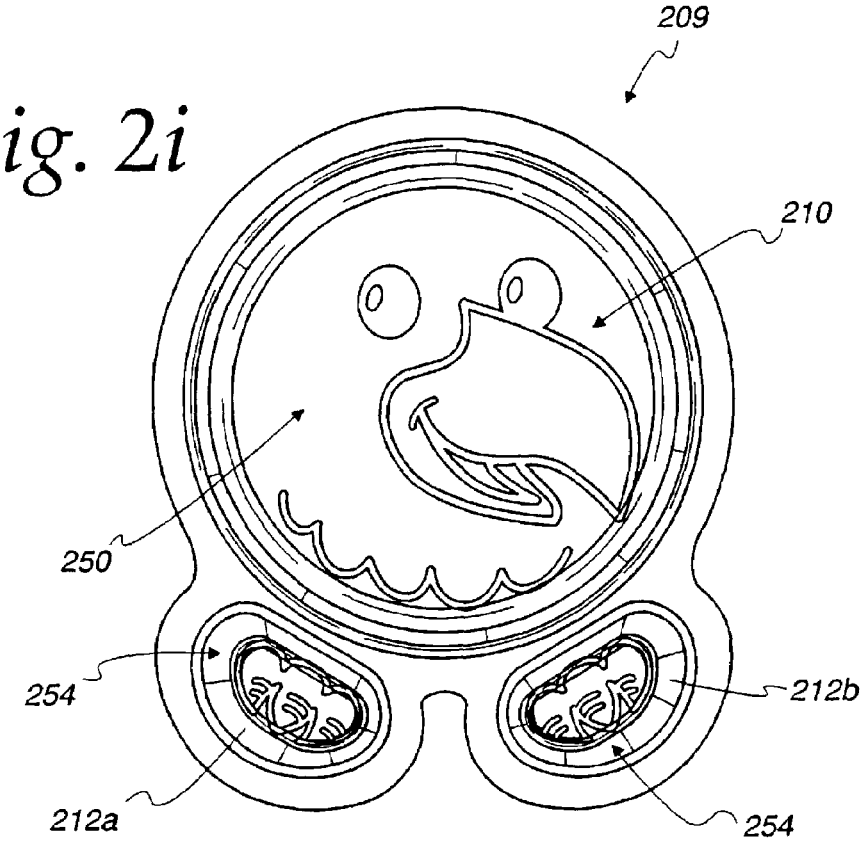
FIG. 2*i* is a top view of a plate having wells with a bird depiction thereon according to one embodiment of the present invention.
Figure 1H:
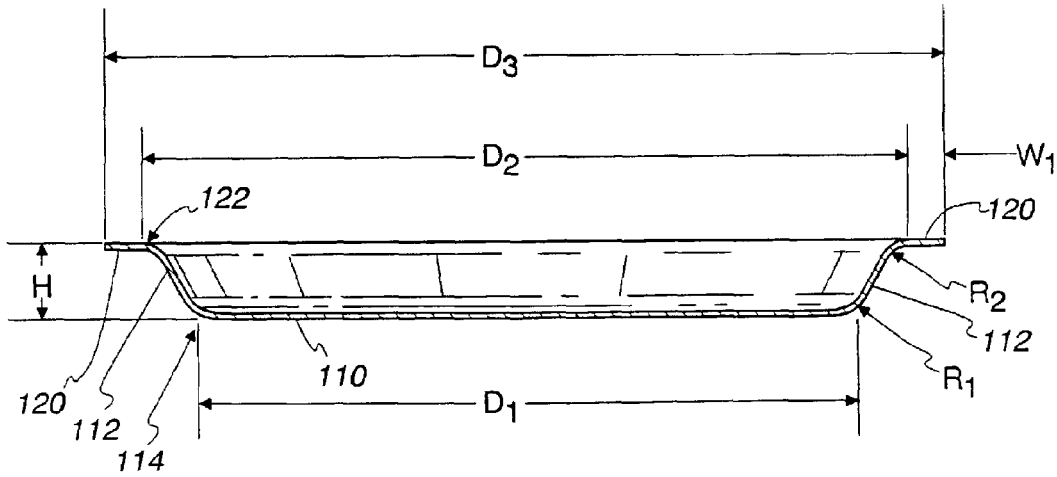
FIG. 1*h* is a sectional view of the plate having wells of FIG. 1*a* taken along line 1*b* of FIG. 1*b*.

Referring to FIG. 1*b* and 1*h*, the flange 120 forms an outer periphery of the plate 100. The outer periphery of the plate 100 comprises an arcuate segment 140 and lobular segments 142. The arcuate segment 140 forms the outer periphery of the main compartment 102 except for the potions of the outer periphery of the main compartment 120 adjacent the wells 104, 106. The lobular segments 142 of the outer periphery of the plate 100 form the outer periphery of the wells 104,106.

The dimensions of the various components of the plate 100 will now be described according to one embodiment of the present invention. The bottom wall 110 is generally circular in shape and has a diameter $D_1$ of approximately 5⅞ inch according to one embodiment of the present invention.

In the illustrated embodiment, the end of the side wall 112 intersecting the bottom wall 110 and the side wall 112 of the main compartment intersect, forming a rounded edge 114 have a radius of curvature $R_1$ of approximately ⅜ inch. The side wall 112 upwardly and outwardly extends from the bottom wall 110 at an angle of approximately 26° relative to the vertical. The side wall 112 curves outward away from the main compartment 102 until it is horizontal, forming a flange 120 around the main compartment 102. The rounded transition 122 between the flange 120 and the side wall 112 has a radius of curvature $R_2$ of about ⅛ inch. The diameter $D_2$ of the main compartment 102 between rounded transitions 122 on opposite sides of the main compartment 102 is about 6⅝ inches The flange 120 has a width $W_1$ of about 7/16 inch, which results in an overall diameter $D_3$ of the main compartment 102 with flanges of approximately 7 15/32 inches. The height H of the plate, measured from the bottom wall 110 to the flange 120, is approximately ⅝ inch.

Referring to FIGS. 1*c* and 1*d*, the plate 100 has a length $L_1$ from the edge of the flange 120 disposed around the condiment wells 104, 106 to the edge of the flange around the main compartment 102 of approximately 8⅞ inches. The length of the plate 100 at its maximum dimension $L_2$—from the edge of the flange around one of the compartment 104, 106 to the edge of the flange 120 disposed around the main compartment 102—is approximately 9 5/16 inches.

Addressing now the condiment wells 104, 106, each compartment has a length $L_3$ of approximately 2 27/32 inch and a width $W_2$ of about 1¾ inch. The embodiment of a plate having the dimensions as described results in a main compartment having a volume of approximately 10 fluid ounces and condiment wells 104, 106 having a capacity of about 1 fluid ounce each.

Turning now to FIGS. 2*a–i*, there are shown a plurality of plates 201–209, similar to plate 100 shown in FIGS. 1*a–i*, having a main compartment 210 and two wells 212*a*, 212*b*. The plates 201–209 collectively correspond to a common theme. According to the illustrated embodiment of the present invention, the common theme is an animal theme: plate 201 has an alligator depicted thereon; plate 202 has a frog depicted thereon; plate 203 has a bumblebee depicted thereon, plate 204 has a fish depicted thereon; plate 205 has a whale depicted thereon; plate 206 has a monkey theme depicted thereon; plate 207 has a bunny rabbit depicted thereon; plate 208 has a turtle depicted thereon; and plate 209 has a bird depicted thereon.

The animal depiction on each plate comprises a primary attribute that is depicted in the plate's main compartment 210 and two secondary attributes that are depicted in the wells 212. For example, referring to the plate 201 of FIG. 2*a*, the alligator has a primary attribute of an alligator face 220 (including snout, nose, and mouth) depicted in the main compartment 210 and the secondary attributes of eyes 222 depicted in the wells 212*a,b*.Likewise, the frog of plate 202 has the primary attribute of a mouth 224 depicted in the main compartment 210 and the secondary attributes of eyes 226 depicted in the wells 212*a,b*. The bumblebee of plate 203 has the primary attribute of a face and body 228 depicted in the main compartment 210 and the secondary attributes of wings 230 depicted in the wells 212*a,b*. The fish of plate 204 has the primary attribute of a head and body 232 depicted in the plate compartment 210 and the secondary attributes of tail fins 234 depicted in the wells 212*a,b*. The whale of plate 205 includes the primary attribute of a head and body 236 depicted in the main compartment 210 and the secondary attributes of tail fins 238 depicted in the wells 212*a,b*. The monkey of plate 206 includes the primary attribute of a head and face 240 depicted in the main compartment 210 and the secondary attributes of ears 242 depicted in the wells 212*a,b*. The bunny rabbit of plate 207 includes the primary attribute of a face and head 244 depicted in the main compartment 210 and the secondary attributes of ears 246 depicted in the wells 212*a,b*. The turtle of plate 208 includes the primary attribute of a face and body 248 depicted in the main compartment 210 and the secondary attributes of feet 250 depicted in the wells 212*a,b*. The bird of plate 210 includes the primary attribute of a face and beak 252 depicted in the main compartment 210 and the secondary attributes of feet or claws 254 depicted in the wells.

According to various embodiments of the present invention, the wells 104, 106 of the plate 100 are positioned relative to the main compartment 100 to match the depiction on the plates. In the embodiments described above wherein the depiction on the plates is an animal depiction, the wells 104, 106 are positioned relative to the main compartment 102 so as to depict the secondary attribute at a position relative to the primary attribute as those features are commonly seen in the particular animal. Referring to plate 207 of FIG. 2*g*, for example, the wells 212*a,b* are positioned relative to the main compartment 210 so that the ears 246 (depicted in the wells 212*a,b*) are positioned on top of the head 255 (depicted in the main compartment 210), which is how a bunny rabbit is commonly seen.

The animal depictions discussed above represent only a few of the many animal depictions that can be disposed in the main compartment 102 and the wells 104,106 of the plate 100 in various embodiments of the present invention. Other animal depictions include dog, elephant, goldfish, harp seal, koala, lion, mouse, owl, pig, parrot, sheep, owl, tiger, duck, cow, dinosaur, fox, hippo, ladybug, lizard, octopus, panda, bear, rhino, snail, cardinal, eagle, leopard, otter, penguin, raccoon, seagull, walrus, and zebra depictions. Further, each of the above discussed depictions can be used in connection with various colors to create additional themes. For example, with the fish depiction of plate 204, the fish is colored blue to create a blue fish depiction and is colored green to create a green fish depiction. In another example, the normally white or black stripes of a zebra are colored a variety of different colors for a plurality of zebra depictions.

The plates can take on other, non-animal themes according to various alternative embodiments of the present invention, such as sports themes, celebrity themes, etc. In sports themed plates, the main compartment may depict various sporting goods, such as a football or basketball, and the wells may depict some other aspect of the sporting good, such as exaggerated laces for a football or one of the panels being kicked off of the soccer ball. Other sports themes include the logos of various sports leagues, team players, team logos, team mascots, team jerseys, etc. In celebrity themed plates, the main compartment may depict a caricature of a celebrity and the wells may depict a feature of that celebrity, such as big ears or eyes.

Figure 3:
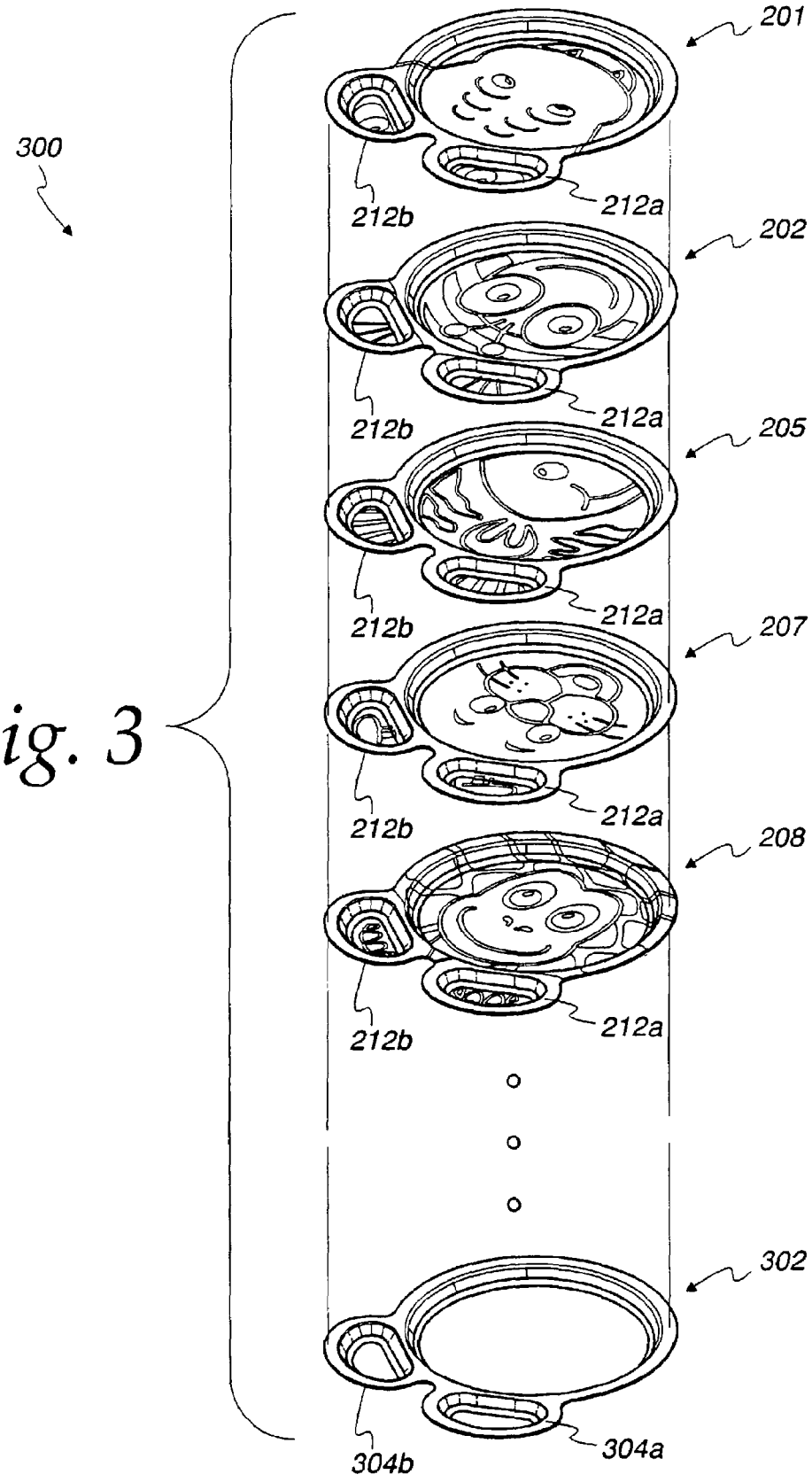
FIG. 3 is an exploded view of a stack of plates having wells with animal depictions disposed thereon according to one embodiment of the present invention.

Turning now to FIG. 3, there is shown an exploded view of a stack 300 of plates 201–208 and 302 having wells 212*a,b* and 304*a,b* Particularly, the alligator plate 201, the bumblebee plate 202, the fish plate 205, the bunny rabbit plate 207, a turtle plate 208, and a blank plate 302 having no depiction thereon are shown stacked upon one another. The blank plate 302 having wells 304*a* and 304*b* represents a plurality of plates that can comprise the stack 300, which may be consistent with the theme or not. The plates 201–208 and 302 are each substantially the same size and shape and are designed to be nestable so that the underside of each plates contacts the upper side of each plate resulting in a compact stack of plates. Because more than two independent compartments nest with each other, the nested plates can not rotate relative to one another.

Figure 4A:
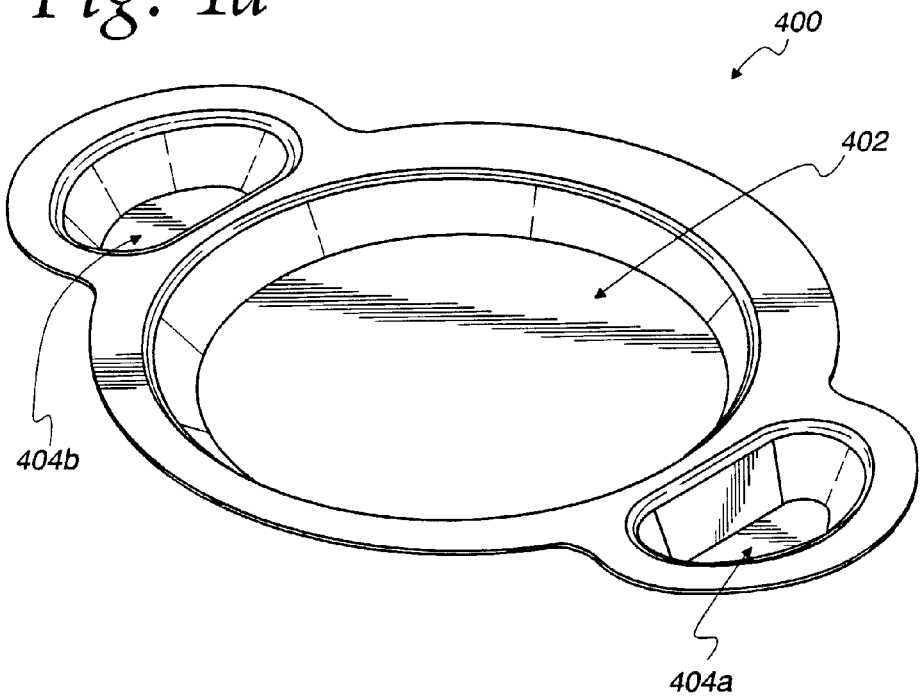
FIGS. 4*a–e* are perspective views of plates having wells according to alternative embodiments of the present invention.
Figure 4B:
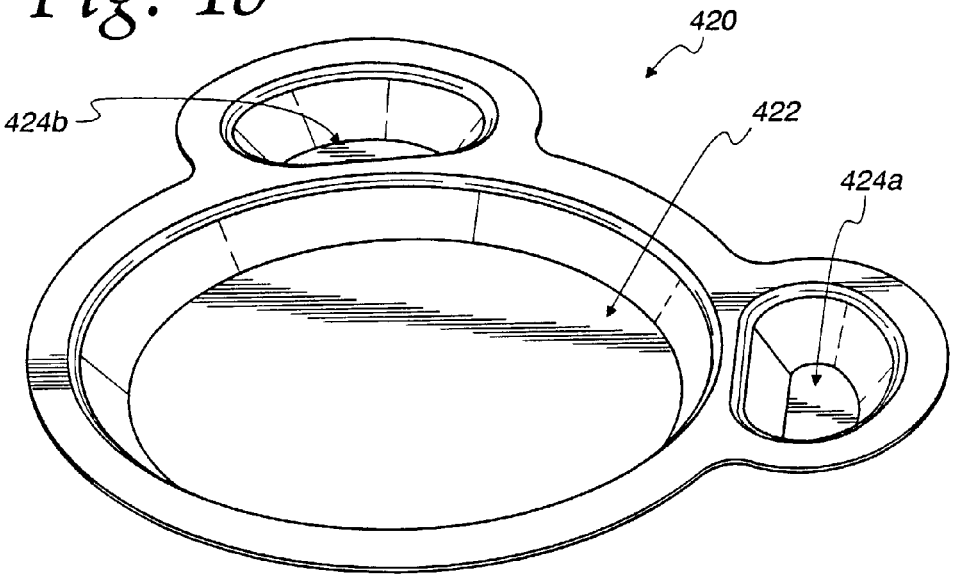
Figure 4C:
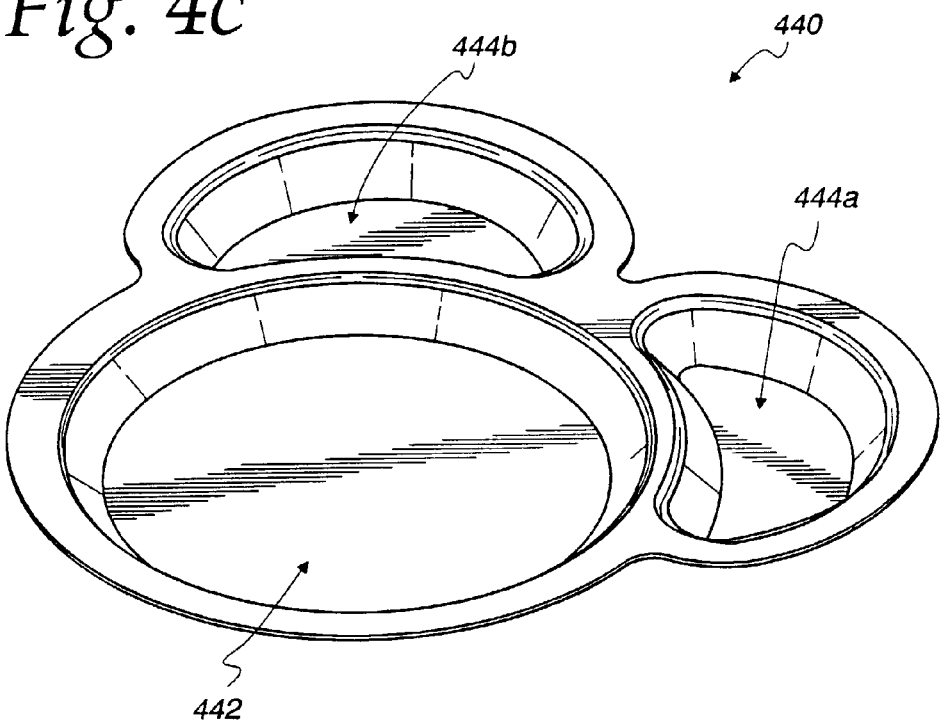
Figure 4D:
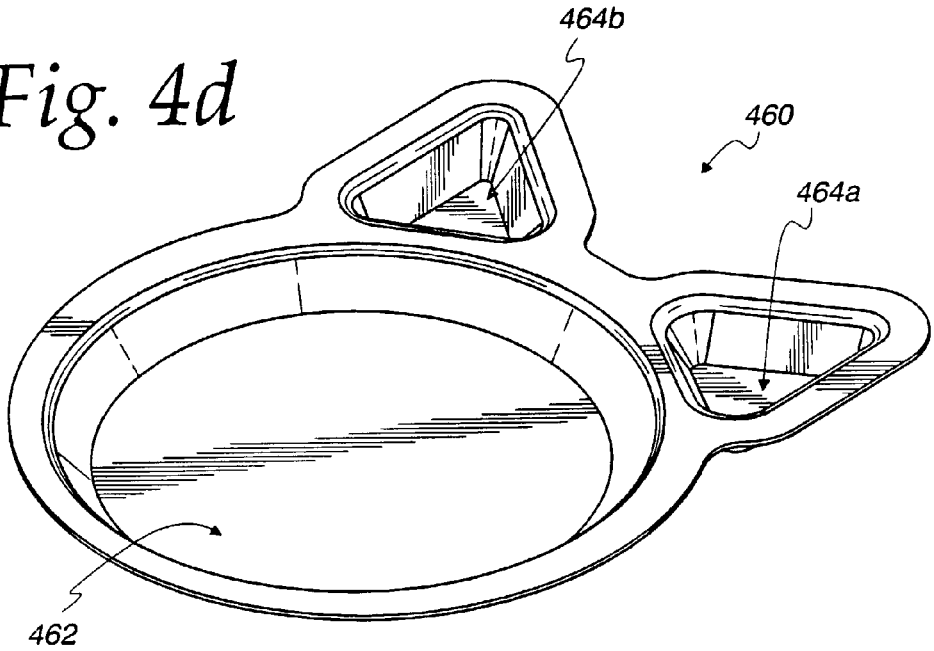
Figure 4E:
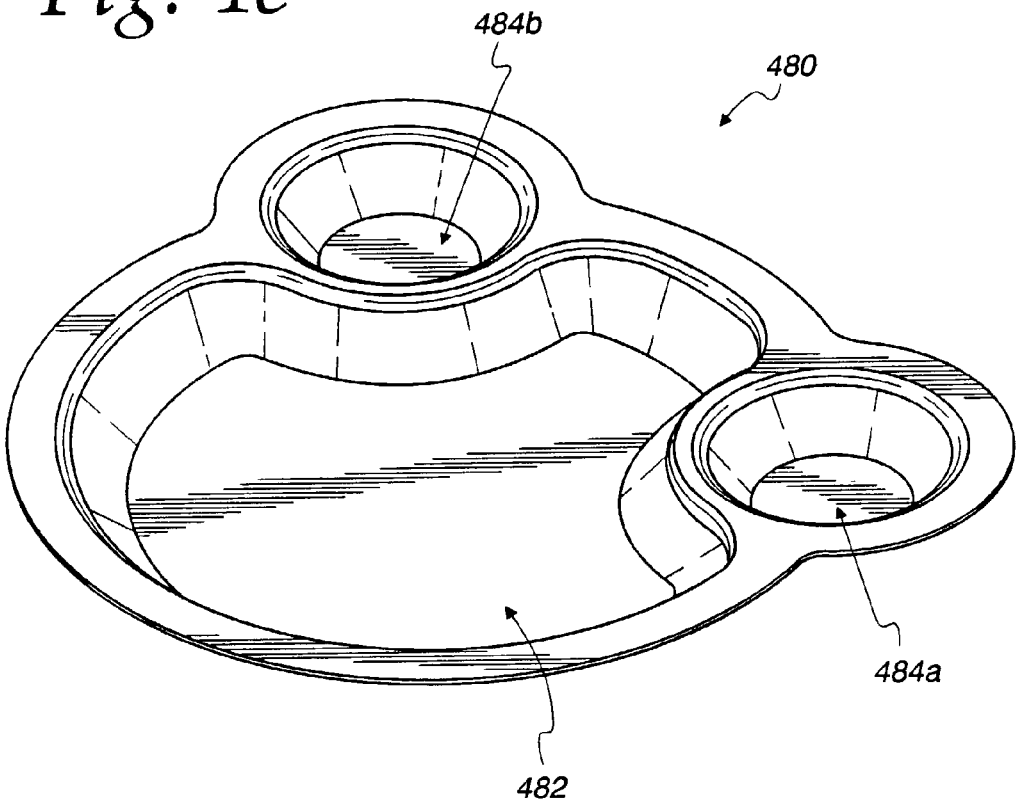

Referring to FIGS. 4*a–e*, there are shown a plurality of different embodiments of plates having wells according to alternative embodiments of the present invention. Referring first to FIG. 4*a*, there is shown a plate 400 having a main compartment 402 and wells 404*a,b* disposed on opposite sides of the main compartment. FIG. 4*b* shows a plate 420 having a main compartment 422 and wells 424*a,b*. The wells 424*a,b* of plate 422 are disposed along the outer periphery of the main compartment 422 and are separated from each other a distance greater than the wells 104, 106 of plate 100 shown in FIG. 1. FIG. 4*c* illustrates a plate 440 having a main compartment 442 and wells 444*a,b*. The wells 444*a,b* are large in comparison to the wells 104, 106 of plate 100. FIG. 4*d* shows a plate 460 having a main compartment 462 and triangular-shaped wells 464*a,b* disposed along the outer periphery of the plate 460. And FIG. 4*d* shows a plate 480 having a main compartment 482 and circular-shaped wells 484*a,b,* which extend into the main compartment 482. The plates 400, 420, 440, 460, and 480 shown in FIGS. 4*a–e* are each stackable and nestable upon other plates of the same design to form a compact stack of plates.

Figure 5:
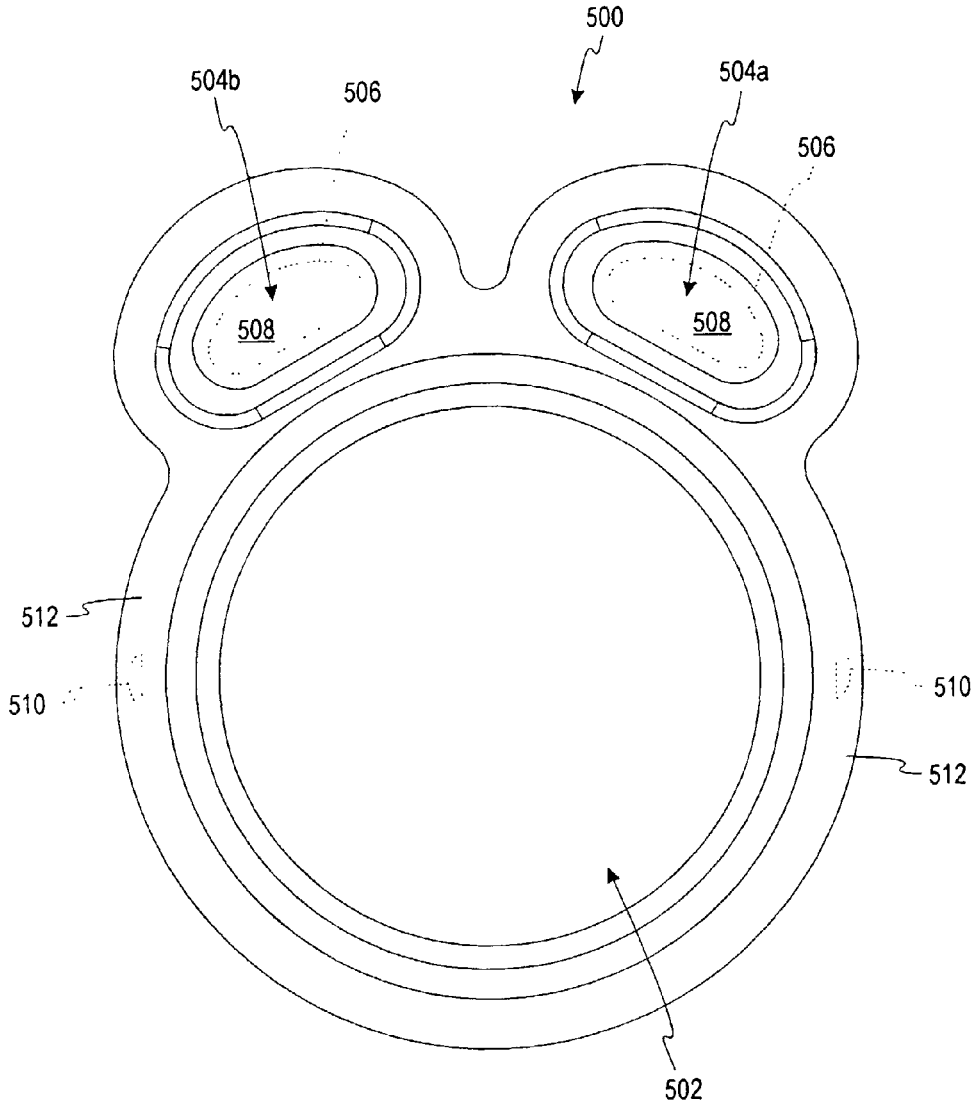
FIG. 5 is a top view of a compartment plate having perforations according to an alternative embodiment of the present invention.

Referring to FIG. 5, there is shown an alternative embodiment of a compartment plate 500. The plate 500, which is similar to the plate 100 described in FIG. 1, includes a main compartment 502 and two wells 504*a,b* disposed along the outer periphery of the main compartment 502. A perforated line 506 is scored into the bottom wall 508 of each compartment 504*a,b*. The perforated lines 506 enable a user of the plate 500, often a child, to remove the bottom walls 508 of the wells 504*a,b* so that the plate can be used as a mask—preferably prior to coming into contact with food. The nature of the plates 500, including the shape and the animal depictions thereon, lend to the use of the plate by children as a mask. The perforations 506 obviate the need for a cutting instrument such as a knife or a pair of scissors; thus, reducing the risk of injury to a child desiring to convert the plate 500 to a mask. The perforations 506 should not be too deep, causing the wells 504*a,b* to be porous to liquids.

Additional perforations 510 are optionally disposed in the flanges 512 surrounding the main compartment 502 on opposite sides of the main compartment 502. Apertures formed by removal of the sections of the flange 512 circumnavigated by the perforations 510 receive ends of pieces of string for securing the plate 500 (being used as a mask) to a child's face. Alternatively, rubber bands or elastic strips can be used to hold the plate 500 on a child's head. Alternatively still, the plate 500 is fastened to stick such as a dowel rod or flat stick, which can be grasp by a hand and held up to a child's face.

As discussed above, the shape of the plate and location of the wells can take on a variety of forms according to alternative embodiments of the present invention. The shape of the plate and location of the wells can vary for different themes to be depicted on the plates in various alternative embodiments of the present invention. In addition to the alternative themes for depiction on plates mentioned above, the following are additional themes that may be depicted on plates having wells in alternative embodiments of the present invention.

According to various alternative embodiments of the present invention, the following themes are depicted on plates having wells similar to the plate 100 of FIGS. 1*a–h*: baby animals; various tropical fish; various birds; various dinosaur designs; animals in costumes indicative of various holidays such as Halloween or Christmas.

In other alternative embodiments of the present invention, the compartment plates take the form of a main compartment that is generally circular in shape and a single triangular-shaped well. An example of themes that are depicted on a plate having such features include various witch faces wherein the circular main compartment depicts a witch's face and the triangular-shaped well depicts the witch's hat. Other themes that can be depicted on this plate include various clown themes, various ice cream cone themes, and various birthday themes which may include animal or human faces depicted in the main compartment and birthday hats depicted in the triangular-shaped well.

Another alternative embodiment includes a generally rectangular three-compartment plate having various state themes, including a state license plate depicted in a main compartment and other state related information (e.g., pictures of the state bird, tree, flower, state capital, state landmarks, etc.) depicted in the wells. Another alternative embodiment includes a generally round plate with scalloped sidewalls and a well in the center with various flower themes depicted on the plate. In another alternative embodiment of the present invention, the body of a butterfly is depicted in a generally oblong central compartment and two wing-shaped compartments depict the butterfly's wings. In yet another alternative embodiment, the compartment plate takes the shape of a traditional tombstone (e.g., rectangular with a semi-circular-shaped end) and has various Halloween related-themes depicted therein. Finally, in still other alternative embodiments of the present invention, compartment plates of most any shape can include "truth or dare question" themes, various cartoon themes, zodiac themes, "spelling bee" themes, or foreign language phrase themes. Additionally, trivia or education trivia questions and answers can be printed on each plate wherein the questions and answers correspond to the particular theme depicted on the plate. For example, on a compartment plate having an alligator depicted therein, messages regarding an alligator's diet, to which regions alligators are indigenous, etc. can be printed on a plate according to an alternative embodiment of the present invention. In still other alternative embodiments, various characters associated with a societal holiday are depicted on plates in holiday themed plates. For example, Mr. and Mrs. Claus are depicted on Christmas themed plates, or Pilgrims and Native Americans are depicted on Thanksgiving themed plates, or various hearts, flowers, cherubs, including Cupid, and Valentine's-day-type messages are depicted on Valentine's Day themed plates. In still other alternative embodiments, various characters or depictions are associated with a seasonal theme such as different colored leafs for autumn, various beach scenes or outdoor themes for summer, snowflake and snowmen themes for winter, flower themes for spring, and so on.

The manufacturing and packaging of the compartment plates, such as the animal-themed compartment plates having animal depictions thereon shown in FIGS. 1*a*–3, will be described. In various alternative embodiments of the present invention, a particular theme can consist of any practical number of associated depictions on the plates For example, in one embodiment of the present invention, there are fifty animal depictions to be disposed on plates. The number depictions per theme, however, can exceed the number of plates commonly stacked and packaged for retail sale. A package of stacked plates for retail sale is made up of twenty-four plates, for example. Thus, in embodiments where there are fifty or more animal designs for depiction on the plates, but only twenty-four plates are being sold together at a time, not all of the depicted animal designs can be placed in one package of stacked plates. In this discussion, twenty-four plates is used as an example of the number of plates per package. In other embodiments, any practical number of plates can be stacked and packaged during manufacturing.

It is desirable to have widespread dissemination of different animal depictions in the marketplace. Towards this end, it is preferable for each package to include a variety of different themes. Placing a plurality of different animal plates per package leads to an increased chance of exposure of all the animal depictions to consumers. A competing factor, on the other hand, is that it is difficult and expensive for each package of twenty-four plates to comprise a random sampling of the fifty or more possible animal depictions. Further, various market factors influence the number depictions per package. For example, as mentioned, variety in the marketplace is desirable. However, parents have indicated a preference that the various depictions be repeated twice per package so that children are not competing over a particular animal depiction. There is a balance to be struck between the preference of including a good distribution of plates per package and the cost associated with having no repeat animal plates per package.

Due to various manufacturing and cost constraints, all of the various plates having animal depictions thereon are not necessarily manufactured simultaneously, but can be done by increasing production capacity. Further manufacturing constraints lend to certain theme plates being manufactured together. For example, plates having similar color schemes are printed together on a web of paperboard prior to being formed as plates.

Figure 6A:
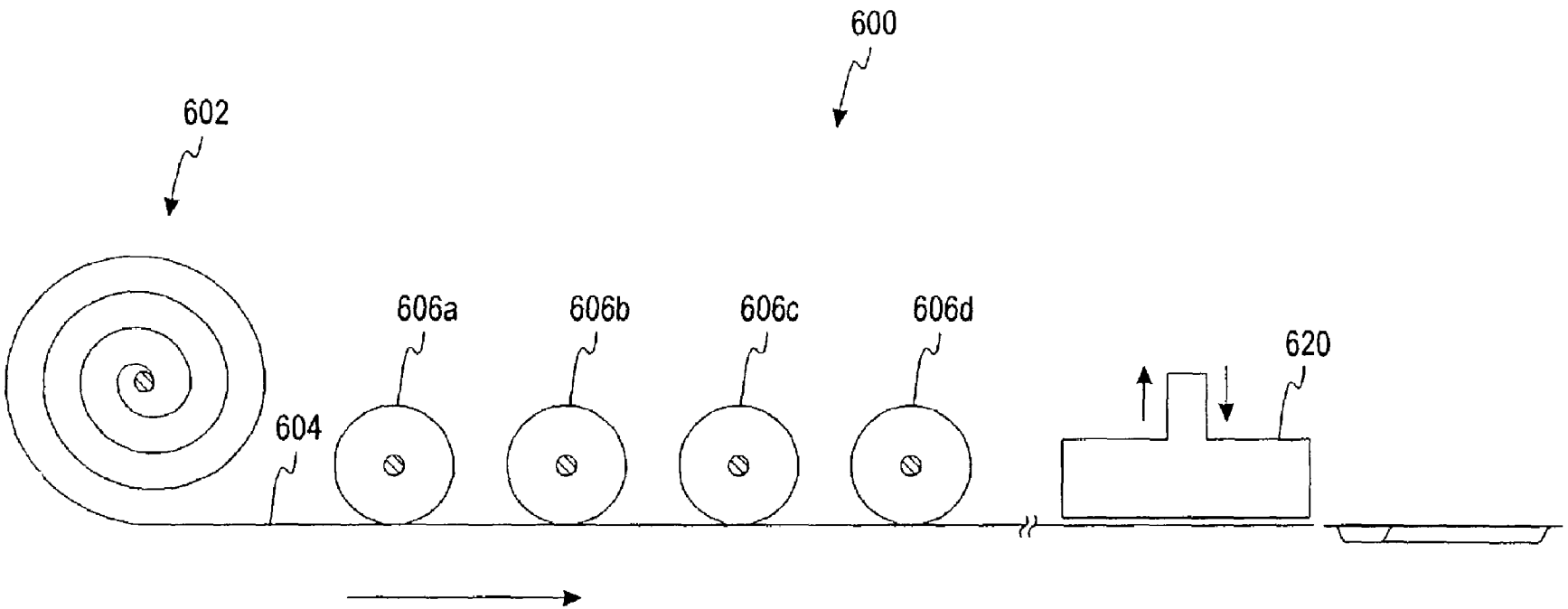
FIGS. 6*a–*6*c* are functional diagrams showing a manufacturing and packaging system for manufacturing and packaging compartment plates having a common theme according to one embodiment of the present invention.

Turning now to FIG. 6*a*, there is shown manufacturing system 600 for making compartment plates having an animal depiction thereon corresponding to a common animal theme. While the ensuing discussion refers to the animal designs depicted on the compartment plates of FIGS. 1*a–h*, the manufacturing and packaging method of the present invention is also applicable to containers (e.g., cups, bowls, etc.) having other depictions disposed thereon according to a common theme. The manufacturing method of the present invention is applicable to other themed items such as dining utensils, place-mats, or straws having a common theme. According to one embodiment of the present invention, prior to forming the plates, each of the animal depictions is printed on paperboard with four different colored inks. Those animal depictions that are printed using the same four colors of ink are manufactured together, while those plates having animals depictions printed with a different four color combination are separately manufactured. As an example, the animal designs depicted on the plates are printed using one of three different sets of four colors: (1) green, pink, yellow, and black; (2) orange, pink, brown, and black; and (3) yellow, red, blue, and black. Additionally, layering of the four ink colors in each of the three sets creates additional colors, for example: the pink and yellow inks of the first four ink set are combined to create a shade of orange; similarly, the red and yellow inks of the third ink set are combined to create a shade of orange; and the blue and yellow inks of the third ink set are combined to create a shade of green. Additionally, the black ink of each of the three four-ink-sets is halftoned to create various shades of gray as is known in the printing art. Alternatively, more than or less than four different ink colors can be used in printing each of the animal depictions. Using less colors, however, limits the color dynamic of the depictions and using more colors adds to the cost.

To create the compartment plates having animal designs depicted thereon, a roll of material 602, such as paperboard, is unrolled and a web of paper 604 is fed in the direction of the arrow past a printing system including four printing cylinders 606*a*, 606*b*, 606*c*, and 606*d* that apply green, pink, yellow, and black, respectively, to the web of paper 604. Each printing cylinder 606 includes a sixteen cell, four by four array, print plate attached to its outer surface. Put another way, each printing cylinder is four cells wide and includes four cells around its circumference. Each cell 608 of the print plate prints one animal depiction on the web of paper 604. The animal depictions do not repeat on a print plate according to one embodiment of the present invention. Because the cells are laid out on the print plate in a 4×4 array, each rotation of the printing cylinder 606 prints a set of sixteen animal depictions.

Figure 6B:
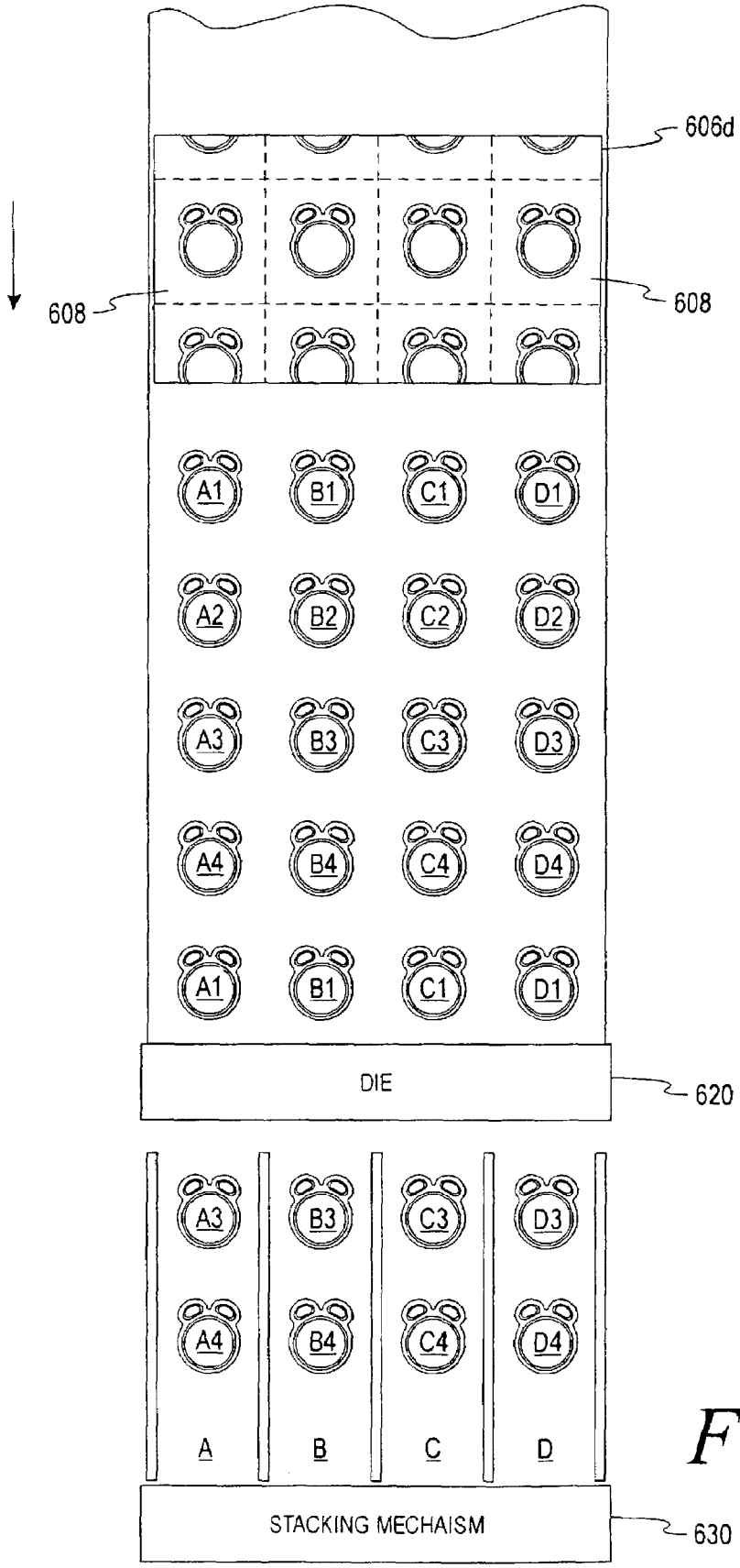

Referring also to FIG. 6*b*, each print cell 608 on each printing cylinder 606 prints a different animal depiction A1–D4 on the web 604 of paperboard as it is advanced in the direction of the arrow. The first printing cylinder 606*a* applies green ink to the web 604 in the appropriate portions of each cell 608 to print the animal depiction in that cell 608. For example, where the cell 608 in the first row and first column of the print plate is to print an alligator design, the first printing cylinder 606*a* applies green ink to the web 604 of paperboard to print the alligator design A1. The second printing cylinder 606*b* then applies some pink ink to the web 604 of paperboard in appropriate places to correspond to the mouth and nasal passages of the alligator design A1. The third cylinder 606*c* does not apply any yellow ink to the web 604 of paperboard at the area of the alligator design A1 because, according to one embodiment of the present invention, the alligator design does not call for any yellow ink. Finally, the forth cylinder 606*d* applies black ink to the web 604 to outline certain features of the alligator depiction.

The web 604 of paperboard having the animal depictions A1–D4 printed thereon is advanced, one row at a time, into the die 620 which includes four tools for forming the plates—one for each lane A–D. The die 620 then stamps or presses the web 604 of paperboard into the three-dimensional plates. Press forming plates from a web of paperboard is known in the art and press forming out of paperboard is described in further detail in U.S. Pat. Nos. 5,129,874 and 5,904,643, each of which is incorporated herein in its entirety. Plates A3–D3 are formed and have just exited the die 620, plates A2–D2 are being formed, and plates A1–D1 are next in line to enter the die 620. After being formed, the plates are maintained in their respective columns A, B, C, and D, also referred to as lanes, as the plates A1–D4 are fed into the stacking mechanism 630.

Figure 6C:
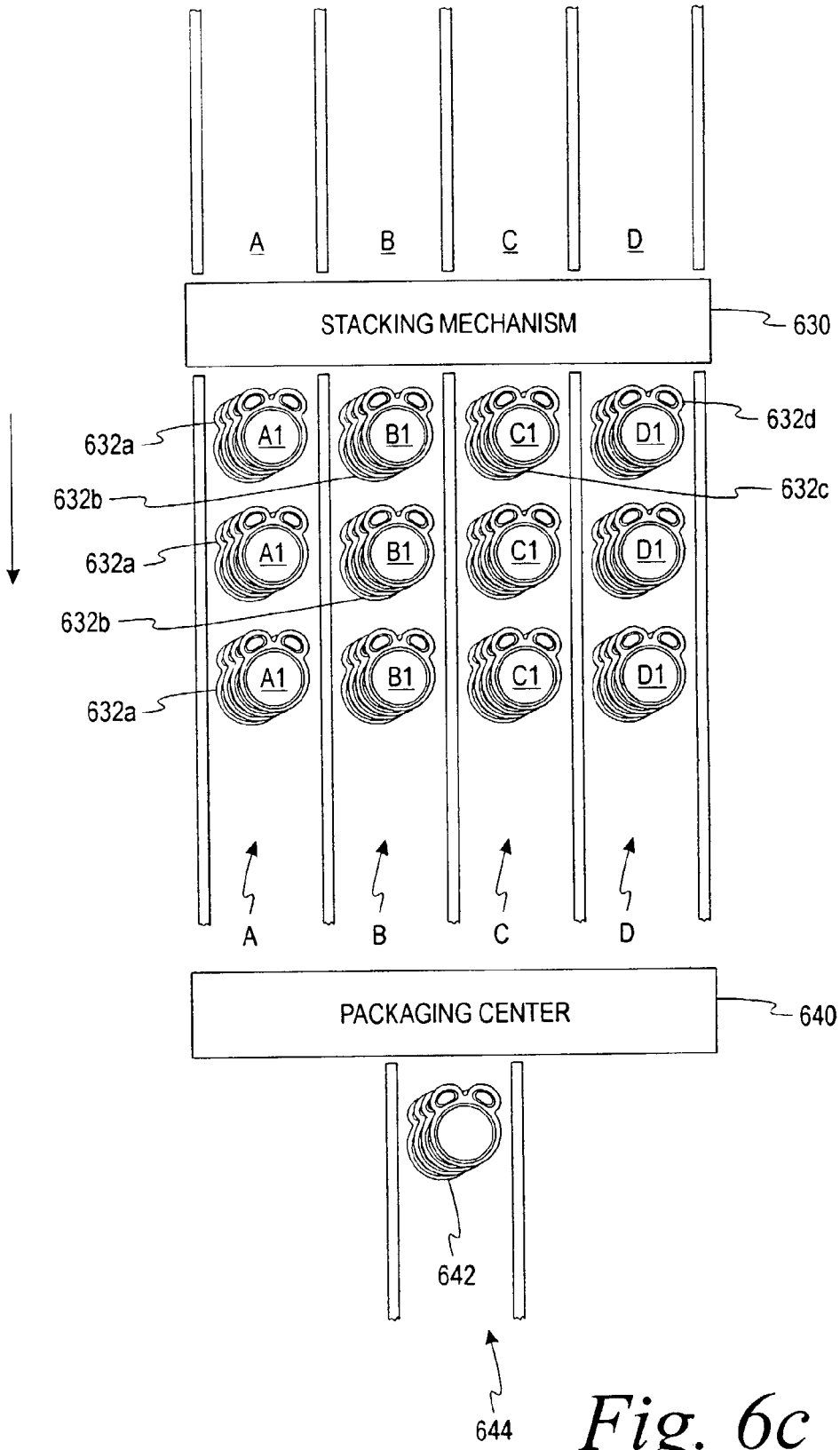

Referring also to FIG. 6*c*, the stacking mechanism 630 stacks plates from each column, or lane, into stacks 632*a*, 632*b*, 632*c*, and 632*d* of twelve (12) plates. Thus, each stack of twelve plates in lane A includes three sets of plates A1–A4. Put another way, each stack includes four different animal depictions A1–A4 that are repeated three times. Although the present invention has been described thus far in connection with specific parameters given as examples, the various parameters, such as number of inks used in printing each animal depiction, the number of cells on the printing plates of the printing cylinders, the number of tools in the die, and the number of plates stacked by the stacking mechanism, can be varied in alternative embodiments of the present invention. Plates manufactured by press forming are typically press formed from dies being two (2) to seven (7) tools wide. Any practical number of plates are stacked by the stacking mechanism. And any practical number of printing cylinders apply different colored inks.

In other alternative embodiments of the present invention, each of the stacks of plates output by the stacking mechanism 630 consist of only six (6) plates per stack and all the lanes A–D are combined to form a stack of twenty-four (24) plates for packaging. A stack in lane A, for example, would include plates A1, A2, A3, A4, A1, and A2 and the subsequent stack in lane A would include plates A3, A4, A1, A2, A3, and A4. Applicants believe that combining two different lanes of stacks of twelve (12) plates to form stacks of twenty-four (24) plates for packaging achieves the desired distribution of many different animal depictions on the plates in the market place in an efficient manner. Further, as is described below, there are other measures to further ensure that many different plates having different animal depictions are distributed in the market place at a given time.

Figure 7:
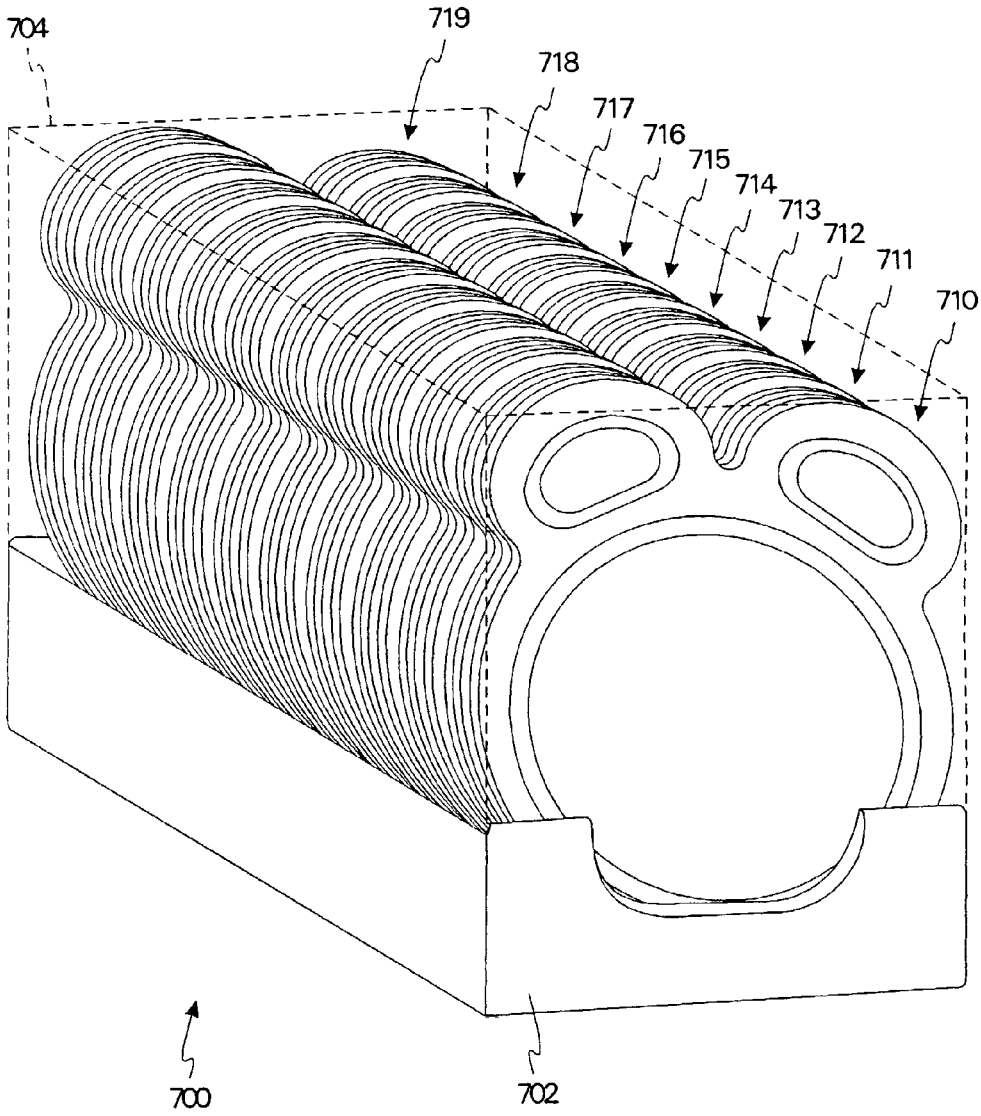
FIG. 7 is a case of compartment plates having a common theme according to one embodiment of the present invention.

Each stack of plates is conveyed along its respective lane A–D to a packaging center 640. In the packaging center, stacks of twenty-four (24) plates are automatically (via automated manufacturing machinery) or manually formed and shrink-wrapped with clear plastic, allowing for a visualization of the plates contained therein. Prior to packing with transparent plastic at the packaging centers 640, the operator(s) assembling the packaged stacks 642 output packages of twenty-four plates for each possible combination of the twelve plate stacks from the four lanes A–D—A&B, A&C, A&D, B&C, B&D, C&D—at near uniform levels to the extent possible with a manual operation. The operators also switch-up which lane's plates are at the top of a stack of twenty-four plates for packing. For example, first an operator may combine lanes B and C so that the stack of twelve plates from lane B is at the top of the stack. And the next time the operator combines lanes B and C, the operator places the stack of twelve plates from lane C on top of those from lane B. Put another way, one combination of lanes B and C may have plate B1 at the top plate in the stack of twenty-four plates for packaging and the next combination of these lanes has plate C1 on the top. In other embodiments, the operator of the packaging center intentionally rotates which of the animal depictions in the twelve plate stacks from the four lanes are on top of the stack. Thus, any of the four animal depictions per lane A–D may appear at the top of a stack of twenty-four plates to be packaged lending to the appearance of an increased variety in the marketplace because the packages that are placed on a retailer's shelf have varying a animal depiction at the front of a stack of plates in a package. Alternatively still, which row of on the printing cylinders is printed first can be varied. For example, in one manufacturing run the printing cylinders 606 are initially rotated so that plates A3, A4, A1, and A2 are printed in that order. Alternatively still, because the packages of animal themed plates are disposed in cases such that they are standing upright as shown in FIG. 7 according to one embodiment of the present invention, the operator may intentionally chose as a top plate in the stack of plates to be packaged a plate having an animal depiction with a wells-up orientation. For example, the Alligator depiction of FIG. 2*a* has a wells-up orientation.

Another factor adding to the overall variety of plates within a package 642 is that plates do become damaged during the manufacturing process. For example, plates are damaged are they are conveyed along lanes A–D, printing errors render plates undesirable, plates are torn or otherwise incorrectly processed by the die, or a combination of these events can occur. When a damaged plate A1–D4 is conveyed to the packaging center 640, the operator discards that plate and inserts an undamaged plate. The animal depiction on the inserted plate does not necessarily correspond to the animal depiction on the discarded, damaged plate or even to any of the plates A1–D4 currently being run on the manufacturing system 600. Rather, the inserted plate can be any one of animal depictions in the theme. From the packaging center, the plates are conveyed along a conveyor 644 to a case assembling center (not shown). While plates are damaged during manufacturing, such occurrences do not happen in regular, predictable intervals that the occurrences can be relied on in an of itself for variety.

In various alternative embodiments of the present invention, a plurality of manufacturing systems 600 (e.g., the three manufacturing lines) run in parallel, each outputting packages of twenty-four plates from their respective packaging centers 640 onto respective conveyors 644 to a common case assembling center. In the illustrated example, each manufacturing systems 600 manufactures sixteen plates having sixteen different animal depictions as described above. In embodiments wherein the total collection of animal depictions comprises forty-five depictions, for example, three different manufacturing system 600 are set-up to output sixteen different plates each in parallel. The extra plate print cell 608 on the print plates of the printing cylinders 606 of each system 600 is either left blank or is used to create duplicate plates of more popular animal depictions. For example, 42 animals are produced once and three animals are produced twice for every one rotation of the cylinders (i.e., three animalsdepictions are printed twice). Each of the three different manufacturing systems 600 in the present example output six different groupings of packaged plates from their packaging centers—combined stacks from lanes A&B, A&C, A&D, B&C, B&D, C&D for each system 600 as discussed above. Because the six different combinations are different from lane to lane, there are a maximum of eighteen different plate packaging combinations produced when three manufacturing systems 600 are implemented. Again, additional variety is implemented by varying which lane's stacks are stack on top in the packaged stack, by the operator's replacement of damaged plates, by the operators intentional rotation of the top plate of a package, or a combination thereof.

In another embodiment of the present invention, each print plate on the printing cylinders is five cells wide and is four cells around resulting in the printing of twenty different animals per rotation of the printing cylinder in five different lanes and a die that is five tools wide for forming the plates. A single stack of twelve plates output from the stacking mechanism is selected from one of the five lanes A–E and combined with another stack of twelve plates from a different one of the five lanes A–E to form a stack of twenty-four (24) plates for packaging. Thus, there are a maximum often (10) different plate combinations per package: combinations of lanes A and B, lanes A and C, lanes A and D, lanes A and E, lanes B and C, lanes B and D, lanes B and E, lanes C and D, lanes C and E, and lanes D and E. One of these combinations results in a maximum of eight (8) different animal plates per package. In other embodiments wherein the die and printing cylinder are five plates wide, for example, there are a maximum of ten different plate stack combinations possible when combining two lanes. According to one embodiment of the present invention, an operator of the packaging center manually combines the plate stacks 632*a–d* from each of the lanes A–D to form the stacks of packaged stack 642 of twenty-four plates.

Referring now to FIG. 7, from the packaging centers of the three manufacturing systems 600, the packaged stacks 642 are conveyed along conveyors 644 to a case assembling center (not shown) wherein the packages 642 of twenty-four plates are combined into a case 700. As discussed above, eighteen different packaged plate stacks, at a maximum when each manufacturing system 600 is four lanes wide, are conveyed to the case assembly center. According to the illustrated embodiment, a case of plates comprises ten packages 710–719. The case includes a bottom tray 702 for holding packaged plate stacks 710–719 and a cover 704 for protecting the plates during shipping and for facilitating the stacking the cases 700 stackable upon one another. The tray 702 and cover 704 define a covering structure useful for sending sets of plate packages into retail distribution. The cover of the case 700 is removable from the tray 702, which is designed to be placed on a retail's shelf. The tray 702 holds the packages 710–719 in a standing fashion so that the faces of the animal depictions on the plates are readily seen.

The operator of the case assembling center selects from the eighteen different packages of themed plates to fill the cases 700. Because there are eighteen different packages to put into a case 700, but only ten spaces in each case, cases formed one after one another do not include the same packages of plates. The operator selects a first group of ten packages to fill a first cases and a second group of packages to fill a second case. For example, where the eighteen different packages are conveyed to the case assembly center in serial fashion, a first case may include package combinations one through ten of eighteen and the second case may include package combinations eleven through eighteen of eighteen and then one through two of eighteen. Thus, many of the cases assembled at the case assembling center are unique from one another. The complete collection of all forty-five animal themes, for example, would be represented in every two cases where each of the eighteen different package combinations are conveyed to the case assembling center in serial fashion. And an identical combination of packages in a case would be repeated every ten cases in that situation. However, further contributing to the uniqueness among cases, the plate packages output by the manufacturing systems 600 are not necessarily distributed to the case assembling center in a uniform fashion. Rather, it is more likely in a somewhat manual operation, as has been described, that packages from each of the manufacturing systems 600 are not uniformly conveyed to the case assembling center. Again, additional variety is implemented by varying which lane's stacks are stacked on top in the packaged stack and by the operator's replacement of damaged plates In an alternative embodiment of the present invention, plates are manufactured using a plurality of different manufacturing systems 600 that feed plates into a single packaging center. Each stacking mechanism 630 of the plurality of manufacturing systems 600 output four lanes A–D of stacked plates—twelve plates per stack. The stacks of twelve plates are conveyed along the respect plurality of lanes A–D to a packaging center where an operator selects plates from two of the lanes to assembly the stacks of twenty-four plates for packing. If there are three different manufacturing system operating, the operator selects from twelve different lanes.

In yet another embodiment of the present invention, six different manufacturing systems 600 or manufacturing lines are implemented for producing compartment plates having a common theme from three different print plates, wherein each manufacturing system has its own packing center and wherein pairs of manufacturing systems share a case assembling center. The first pair of manufacturing systems may produce plates from a first and second print plate, the second pair of manufacturing system may produce plates from a first and third print plate, and the third pair of manufacturing systems may produce plates from a second and third print plate. Because each pair of manufacturing systems share a case assembling center, each cases includes plates from a maximum of two different print plates. The cases from each of the three case assembling centers are commingled in one or more pallet assembling areas.

The trays 702 of several cases 700 are stackable for display one top of one another and side-by-side. Due to the varied animal depictions appearing at the front of the each of the cases, enhanced customer recognition of the variety of animal depictions within the animal theme is achieved. In other alternative embodiments of the present invention, one or more cases 700 of packaged themed plates are shipped in a "display shipper" that servers as a stand for displaying the plates in a retail location. Cases 700 are stacked side-by-side and upon each other in the display shipper. Additionally, the display shipper may include other similarly themed items such as cups, bowls, utensils, plate-mats, etc. that all bare the common animal theme.

Figure 8:
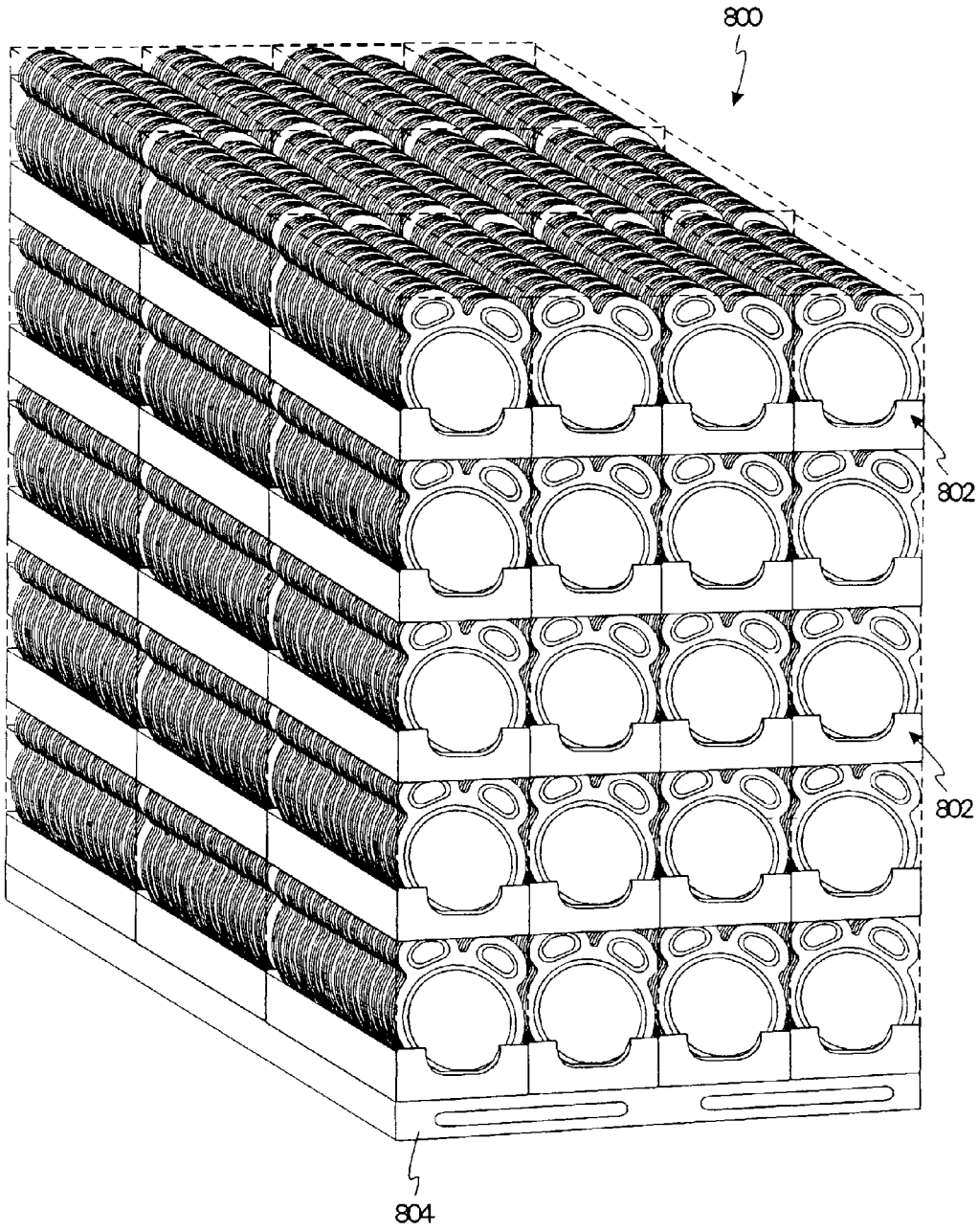
FIG. 8 is a pallet of the cases of FIG. 7.

Referring now to FIG. 8, a pallet 800 of cases 802 of packaged plates is shown. The cases 802 are stacked upon a shipping pallet 804, such as a wooden or cardboard shipping pallet. According to the illustrated embodiment, the pallet 800 includes 60 cases of plates stacked thereon—four cases wide by three cases deep by five cases high. Thus, 14,400 plates form a single pallet. The cases 802 are shown in FIG. 8 stacked and lined up end-to-end. Alternatively, the cases may be stacked in staggered fashion. Typically, the plates are shipped to high-volume retailers on pallets. Alternatively, a plurality of cases (e.g., sixty) are stacked upon each other and packaged in a unitized fashion without the use of a pallet The distribution variety of the plates into the cases also translates into a distribution variety among the stack cases on or not on the pallets.

In an alternative embodiment of the present invention, a unique "prize plate" is included with a package of themed plates. The prize plate is manually or automatically inserted within a stack of plates during the assembling of the themed plates in a stack for packaging. A prize plate having a unique depictions corresponding to the theme that is inserted in a limited number of plate packages. For example, keeping with the animal theme, a prize plate may have a black cat design depicted thereon. The prize plate is a promotional tool making the purchaser of a package of theme plates containing the prize plate eligible for a prize. The prize may include coupons for plates, cash, or novelty items such as a toy having an animal theme depicted thereon. Alternatively, the prize plate may have a code disposed thereon that the customer uses to access a website on the Internet that lists prizes that the customer may choose among.

In addition to the embodiments described above or in the accompanying claims, several embodiments of the present invention will now be described.

ALTERNATIVE EMBODIMENT A1

A1. An arrangement of plates for receiving food, comprising:

a plurality of nestable plates, plates within said plurality of nestable plates having an animal theme, each plate having said animal theme including, a main compartment depicting a primary attribute of an animal corresponding to said animal theme, and at least two independent wells adjacent to said main compartment, each of said wells being shaped to depict a secondary attribute of said animal corresponding to said animal theme; and wherein said plurality of plates include a first plate depicting a first animal and a second plate depicting a second animal that is different from said first animal, said secondary attribute within said wells of said first plate being a first physical feature of said first animal and said secondary attribute within said wells of said second plate being a second physical feature of said second animal, said first physical feature being different from said second physical feature while said wells of said first and second plates are similarly shaped to allow said plurality of plates to be nestable.

ALTERNATIVE EMBODIMENT A2

A2. The arrangement of alternative embodiment A1, wherein at least a portion of a periphery of said main compartment is generally circular.

ALTERNATIVE EMBODIMENT A3

A3. The arrangement of alternative embodiment A1, wherein said primary attributes of said first plate and said second plate include facial parts.

ALTERNATIVE EMBODIMENT A4

A4. The arrangement of alternative embodiment A3, wherein said secondary attribute of said first plate is ears and said secondary attribute of said second plate is feet or claws.

ALTERNATIVE EMBODIMENT A5

A5. The arrangement of alternative embodiment A3, wherein said secondary attribute of said first plate is fish fins and said secondary attribute of said second plate is eyes.

ALTERNATIVE EMBODIMENT A6

A6. The arrangement of alternative embodiment A1, wherein said first animal and said second animal are selected from the group consisting of fish, sheep, whales, birds, horses, zebras, frogs, turtles, tigers, cats, and dogs.

ALTERNATIVE EMBODIMENT A7

A7. The arrangement of alternative embodiment A1, wherein said wells are generally rounded.

ALTERNATIVE EMBODIMENT A8

A8. The arrangement of alternative embodiment A1, wherein each of said plates within said plurality of plates has depictions associated with said animal theme.

ALTERNATIVE EMBODIMENT A9

A9. The arrangement of alternative embodiment A1, wherein said wells extend outwardly from a portion of a periphery of said plate that defines said main compartment.

ALTERNATIVE EMBODIMENT A10

A10. An arrangement of plates for receiving food, comprising:

a plurality of nestable plates, plates within said plurality of nestable plates having an animal theme, each plate having said animal theme including, a main compartment depicting a primary attribute of an animal, and at least two independent wells adjacent to said main compartment, each of said wells depicting a secondary attribute of said animal, each of said wells being located relative to said main compartment so as to depict said secondary feature at a position relative to said primary feature that is commonly seen in said animal; and wherein said plurality of plates include a first plate depicting a first animal and a second plate depicting a second animal that is different from said first animal, said secondary attribute within said wells of said first plate being a first physical feature of said first animal and said secondary attribute within said wells of said second plate being a second physical feature of said second animal, said first physical feature being different from said second physical feature while said wells of said first and second plates are similarly shaped to allow said plurality of plates to be nestable.

ALTERNATIVE EMBODIMENT A11

A11. The arrangement of alternative embodiment A10, wherein at least a portion of a periphery of said main compartment is generally circular and said wells are located around said periphery such that an angle between midpoints in said wells and a midpoint of said main compartment is less than about 90 degrees.

ALTERNATIVE EMBODIMENT A12

A12. The arrangement of alternative embodiment A10, wherein said primary attributes of said first plate and said second plate include facial parts.

ALTERNATIVE EMBODIMENT A13

A13. The arrangement of alternative embodiment A12, wherein said secondary attribute of said first plate is ears and said secondary attribute of said second plate is feet or claws.

ALTERNATIVE EMBODIMENT A14

A14. The arrangement of alternative embodiment A12, wherein said secondary attribute of said first plate is fins and said secondary attribute of said second plate is eyes.

ALTERNATIVE EMBODIMENT A15

A15. The arrangement of alternative embodiment A10, wherein said first animal and said second animal are selected from the group consisting of fish, sheep, whales, birds, horses, zebras, frogs, turtles, tigers, cats, and dogs.

ALTERNATIVE EMBODIMENT A16

A16. The arrangement of alternative embodiment A10, wherein said wells extend outwardly from a portion of a periphery of said plate that defines said main compartment.

ALTERNATIVE EMBODIMENT A17

A17. The arrangement of alternative embodiment A10, wherein said wells have shapes that approximate shapes associated with said secondary features.

ALTERNATIVE EMBODIMENT A18

A18. The arrangement of alternative embodiment A10, wherein each of said plates within said plurality of plates has depictions associated with said animal theme.

ALTERNATIVE EMBODIMENT A19

A19.An arrangement of plates for receiving food, comprising:

a plurality of nestable plates, plates within said plurality of plates having an animal theme, each plate having said animal theme including, a main compartment depicting a primary attribute of an animal corresponding to said animal theme, at least two independent wells adjacent to said main compartment, and a periphery around said wells and said main compartment, said periphery including a primary arcuate segment and two lobular segments, each of said two lobular segments is adjacent to said arcuate segment and extends outward therefrom, each of said two lobular segments of said periphery defining a lobular region depicting a secondary attribute of said animal corresponding to said animal theme, each of said lobular regions being located relative to said main compartment so as to depict said secondary feature at a position relative to said primary feature that is commonly seen in said animal;

wherein said plurality of plates include a first plate depicting a first animal and a second plate depicting a second animal that is different from said first animal, said secondary attribute within said lobular regions of said first plate being a first physical feature of said first animal and said secondary attribute within said lobular regions of said second plate being a second physical feature of said second animal, said first physical feature being different from said second physical feature while said lobular regions of said first and second plates are similarly shaped.

ALTERNATIVE EMBODIMENT A20

A20. The arrangement of plates of alternative embodiment A19, wherein said wells are located at least partially within said lobular regions.

ALTERNATIVE EMBODIMENT A21

A21. The arrangement of plates of alternative embodiment A19, wherein said arcuate segment is substantially circular so as to be on a common radius from a central point within said plate.

ALTERNATIVE EMBODIMENT A22

A22. The arrangement of plates of alternative embodiment A19, wherein said lobular regions are curvilinear.

ALTERNATIVE EMBODIMENT A23

A23. The arrangement of plates of alternative embodiment A19, wherein midpoints of said lobular regions are located less than about 90 degrees from each other as measured from a central point of said main compartment.

ALTERNATIVE EMBODIMENT A24

A24. The arrangement of plates of alternative embodiment A19, wherein each of said plates includes a raised rim adjacent to said arcuate segments that defines an inside segment of said lobular regions.

ALTERNATIVE EMBODIMENT A25

A25. The arrangement of plates of alternative embodiment A24, wherein said wells are located within said lobular regions.

ALTERNATIVE EMBODIMENT A26

A26. The arrangement of plates of alternative embodiment A25, wherein midpoints of said lobular regions are located less than about 90 degrees from each other as measured from a midpoint of said main compartment.

ALTERNATIVE EMBODIMENT A27

A27. The arrangement of plates of alternative embodiment A19, wherein said primary attributes of said first plate and said second plate include facial parts.

ALTERNATIVE EMBODIMENT A28

A28. The arrangement of plates of alternative embodiment A27, wherein said secondary attribute of said first plate is ears and said secondary attribute of said second plate is feet or claws.

ALTERNATIVE EMBODIMENT A29

A29. The arrangement of plates of alternative embodiment A27, wherein said secondary attribute of said first plate is fins and said secondary attribute of said second plate is eyes.

ALTERNATIVE EMBODIMENT A30

A30. The arrangement of plates of alternative embodiment A19, wherein said first animal and said second animal are selected from the group consisting of fish, sheep, whales, birds, horses, zebras, frogs, turtles, tigers, cats, and dogs.

ALTERNATIVE EMBODIMENT A31

A31. The arrangement of plates of alternative embodiment A19, wherein each of said plates within said plurality of plates has depictions associated with said animal theme.

ALTERNATIVE EMBODIMENT A32

A32.An arrangement of plates for receiving food, comprising:

a plurality of nestable plates, plates within said plurality of plates having an animal theme, each plate having said animal theme including, at least one compartment depicting a first attribute of an animal corresponding to said animal theme, and a periphery that surrounds said at least one compartment, said periphery including a primary arcuate segment and at least one lobular segment, said at least one lobular segment is adjacent to said arcuate segment and extends outward therefrom, said at least one lobular segment defining a lobular region depicting a secondary attribute of said animal corresponding to said animal theme, said lobular region being located relative to said main compartment so as to depict said secondary feature at a position relative to said primary feature that is commonly seen in said animal; and wherein said plurality of plates include a first plate having a first animal theme associated with a first animal and a second plate having a second animal theme associated with a second animal that is different from said first animal theme, said secondary attribute within said lobular region of said first plate being a first physical feature of said first animal and said secondary attribute within said lobular region of said second plate being a second physical feature of said second animal, said first physical feature being different from said second physical feature while said lobular region of said first and second plates are similarly shaped.

ALTERNATIVE EMBODIMENT A33

A33. The arrangement of plates of alternative embodiment A32, wherein said primary attributes of said first plate and said second plate include facial parts.

ALTERNATIVE EMBODIMENT A34

A34. The arrangement of plates of alternative embodiment A33, wherein said secondary attribute of said first plate is ears and said secondary attribute of said second plate is feet or claws.

ALTERNATIVE EMBODIMENT A35

A35. The arrangement of plates of alternative embodiment A33, wherein said secondary attribute of said first plate is fins and said secondary attribute of said second plate is eyes.

ALTERNATIVE EMBODIMENT A36

A36. The arrangement of plates of alternative embodiment A32, wherein said first animal and said second animal are selected from the group consisting of fish, sheep, whales, birds, horses, zebras, frogs, turtles, tigers, cats, and dogs.

ALTERNATIVE EMBODIMENT A37

A37. The arrangement of plates of alternative embodiment A32, wherein each of said plates within said plurality of plates has depictions associated with said animal theme.

ALTERNATIVE EMBODIMENT A38

A38. The arrangement of plates of alternative embodiment A32, wherein said well is located at least partially within said lobular region.

ALTERNATIVE EMBODIMENT A39

A39. An arrangement of plates for receiving food, comprising:

a plurality of nestable plates, plates within said plurality of nestable plates including different depictions associated with said common theme, each plate including a main compartment having a first portion of said depiction and at least one well adjacent to said main compartment, said well being shaped and located relative to said main compartment to depict a second portion of said depiction; and a package for containing said plurality of nestable plates of said common theme.

ALTERNATIVE EMBODIMENT A40

A40. The arrangement of plates of alternative embodiment A39, wherein each of said plates includes a second well to depict a third portion of said depiction.

ALTERNATIVE EMBODIMENT A41

A41. The arrangement of plates of alternative embodiment A39, wherein each plate in said package has a different depiction.

ALTERNATIVE EMBODIMENT A42

A42. The arrangement of plates of alternative embodiment A39, wherein said common theme is a commonly known societal holiday.

ALTERNATIVE EMBODIMENT A43

A43. The arrangement of plates of alternative embodiment A42, wherein said holiday is Thanksgiving.

ALTERNATIVE EMBODIMENT A44

A44. The arrangement of plates of alternative embodiment A43, wherein said different depictions include pilgrim faces, turkeys, and Indians.

ALTERNATIVE EMBODIMENT A45

A45. The arrangement of plates of alternative embodiment A42, wherein said holiday is Halloween.

ALTERNATIVE EMBODIMENT A46

A46. The arrangement of plates of alternative embodiment A45, wherein said different depictions include witches, monsters, and pumpkins.

ALTERNATIVE EMBODIMENT A47

A47. The arrangement of plates of alternative embodiment A42, wherein said holiday is Christmas.

ALTERNATIVE EMBODIMENT A48

A48. The arrangement of plates of alternative embodiment A47, wherein said different depictions include Santa Claus, reindeer, and Snowman.

ALTERNATIVE EMBODIMENT A49

A49. The arrangement of plates of alternative embodiment A39, wherein said common theme is a sports theme.

ALTERNATIVE EMBODIMENT A50

A50. The arrangement of plates of alternative embodiment A49, wherein said sports theme is a commonly known sports team, said different depictions include players associated with said sports team.

ALTERNATIVE EMBODIMENT A51

A51. The arrangement of plates of alternative embodiment A49, wherein said sports team is a commonly known sports league, said different depictions including teams within said league.

ALTERNATIVE EMBODIMENT A52

A52. The arrangement of plates of alternative embodiment A39, wherein said theme is an animal theme, said different depictions including different animals.

ALTERNATIVE EMBODIMENT A53

A53. The arrangement of plates of alternative embodiment A39, wherein said theme is an insect theme, said different depictions including different insects.

ALTERNATIVE EMBODIMENT A54

A54. The arrangement of plates of alternative embodiment A39, wherein said theme is a vehicle theme, said different depictions including different vehicles.

ALTERNATIVE EMBODIMENT A55

A55. The arrangement of plates of alternative embodiment A39, wherein said theme is a bird theme, said different depictions including different birds.

ALTERNATIVE EMBODIMENT A56

A56. The arrangement of plates of alternative embodiment A39, wherein each of said plates within said plurality of plates has depictions associated with said common theme.

ALTERNATIVE EMBODIMENT A57

A57. The arrangement of plates of alternative embodiment A39, wherein said plates further include written information associated with said different depictions.

ALTERNATIVE EMBODIMENT A58

A58. The arrangement of plates of alternative embodiment A39, wherein said plates have a circular periphery.

ALTERNATIVE EMBODIMENT A59

A59. The arrangement of plates of alternative embodiment A39, wherein said package is transparent for identifying said common theme.

ALTERNATIVE EMBODIMENT A60

A60. An arrangement of containers, comprising:

a plurality of nestable containers, containers within said plurality of nestable containers including different depictions associated with said common theme, each container including a main compartment having said depiction; and a package for containing said plurality of nestable containers.

ALTERNATIVE EMBODIMENT A61

A61. The arrangement of plates of alternative embodiment A60, wherein said plates have a circular periphery.

ALTERNATIVE EMBODIMENT A62

A62. The arrangement of plates of alternative embodiment A60, wherein said plates further include at least one well.

ALTERNATIVE EMBODIMENT A63

A63. The arrangement of plates of alternative embodiment A60, wherein each of said plates within said plurality of plates has depictions associated with said common theme.

ALTERNATIVE EMBODIMENT A64

A64. The arrangement of plates of alternative embodiment A60, wherein said plurality of plates include a greater number of different depictions than a number of repeats of the same depiction.

ALTERNATIVE EMBODIMENT A65

A65. The arrangement of plates of alternative embodiment A63, wherein said package is transparent for identifying said common theme.

ALTERNATIVE EMBODIMENT A66

A66. An arrangement of plates for receiving food, comprising:

a plurality of nestable plates, each plate within said plurality of nestable plates including a depiction associated with said common theme and a written message associated with said depiction, said plurality of plates including plates having different depictions; and a package for containing said plurality of nestable plates.

ALTERNATIVE EMBODIMENT A67

A67. The arrangement of plates of alternative embodiment A66, wherein said written message provides information about said depiction.

ALTERNATIVE EMBODIMENT A68

A68. The arrangement of plates of alternative embodiment A66, wherein said written message is trivia.

ALTERNATIVE EMBODIMENT A69

A69. The arrangement of plates of alternative embodiment A66, wherein said written message includes instructions on playing a game.

ALTERNATIVE EMBODIMENT A70

A70. The arrangement of plates of alternative embodiment A66, wherein each of said plates within said plurality of plates has depictions and associated written messages that correspond to said common theme.

ALTERNATIVE EMBODIMENT A71

A71. The arrangement of plates of alternative embodiment A66, wherein said package is transparent for identifying said common theme.

Alternative Embodiment A72

A72. An arrangement of plates for receiving food, comprising:

a plurality of nestable plate, plates within said plurality of nestable plates including different depictions associated with said common theme, each plate including a main compartment having said depiction; and a package for containing said plurality of nestable plates.

ALTERNATIVE EMBODIMENT A73

A73. The arrangement of plates of alternative embodiment A72, wherein said plates have a circular periphery.

ALTERNATIVE EMBODIMENT A74

A74. The arrangement of plates of alternative embodiment A72, wherein said plates further include at least one well.

ALTERNATIVE EMBODIMENT A75

A75. The arrangement of plates of alternative embodiment A72, wherein each of said plates within said plurality of plates has depictions associated with said common theme.

ALTERNATIVE EMBODIMENT A76

A76. The arrangement of plates of alternative embodiment A72, wherein said plurality of plates include a greater number of different depictions than a number of repeats of the same depiction.

ALTERNATIVE EMBODIMENT A77

A77. The arrangement of plates of alternative embodiment A72, wherein said package is transparent for identifying said common theme.

ALTERNATIVE EMBODIMENT B1

B1. A case of plate packages, comprising:

a plurality of plate packages, each plate package including a plurality of nestable plates and a transparent wrapping for enveloping said plurality of nestable plates, plates within said plurality of nestable plates including different depictions associated with a common theme, each of said plurality of nestable plates including a top plate that is at least partially visualized through said transparent wrapping, said top plates for said plurality of plate packages including plates with different depictions; and a covering structure surrounding said plurality of plate packages.

ALTERNATIVE EMBODIMENT B2

B2. The case of alternative embodiment B1, wherein each plate within said plurality of plate packages includes a main compartment having a first portion of said depiction and at least one well adjacent to said main compartment, said well being shaped and located relative to said main compartment to depict a second portion of said depiction.

ALTERNATIVE EMBODIMENT B3

B3 The case of alternative embodiment B1, wherein said covering structure includes a tray and a cover.

ALTERNATIVE EMBODIMENT B4

B4. The case of alternative embodiment B3, wherein said tray is configured to maintain said plurality of plate packages in an upright position for retail display.

ALTERNATIVE EMBODIMENT B5

B5. The case of alternative embodiment B4, wherein said common theme includes an animal theme and said depictions include animal faces, said top depicting animal faces that are held in said upright position by said tray.

ALTERNATIVE EMBODIMENT B6

B6. The case of alternative embodiment B1, wherein said top plate in each of said plurality of plate packages has a depiction that is different from the depictions on others of said top plates.

ALTERNATIVE EMBODIMENT B7

B7. The case of alternative embodiment B1, wherein said theme is an animal theme, said different depictions including different animals.

ALTERNATIVE EMBODIMENT B8

B8. The case of alternative embodiment B1, wherein said theme is an insect theme, said different depictions including different insects.

ALTERNATIVE EMBODIMENT B9

B9 The case of alternative embodiment B1, wherein said theme is a vehicle theme, said different depictions including different vehicles.

ALTERNATIVE EMBODIMENT B10

B10. The case of alternative embodiment B1, wherein said theme is a bird theme, said different depictions including different birds.

ALTERNATIVE EMBODIMENT B11

B11. The case of alternative embodiment B1, wherein each of said plates within said plurality of nestable plates has a depiction associated with said common theme.

ALTERNATIVE EMBODIMENT B12

B12 A case of plate packages, comprising:

a plurality of plate packages, each plate package including a plurality of nestable plates and a transparent wrapping for enveloping said plurality of nestable plates, each of said plurality of nestable plates including a top plate that is at least partially visualized through said transparent wrapping, said top plates for said plurality of plate packages including plates with different depictions; and a covering structure surrounding said plurality of plate packages.

ALTERNATIVE EMBODIMENT B13

B13. The case of alternative embodiment B12, wherein each of said plates within said plurality of nestable plates has a depiction associated with a common theme.

ALTERNATIVE EMBODIMENT B14

B14. The case of alternative embodiment B12, wherein said covering structure includes a tray and a cover that is removable from said tray.

ALTERNATIVE EMBODIMENT B15

B15. The case of alternative embodiment B14, wherein said tray is configured to maintain said plurality of plate packages in an upright position for retail display.

ALTERNATIVE EMBODIMENT B16

B16. The case of alternative embodiment B15, wherein said case contains plates with an animal theme and said depictions include animals, said top plates each depicting an animal that is held in said upright position by said tray.

ALTERNATIVE EMBODIMENT B17

B17. The case of alternative embodiment B12, wherein said top plate in each of said plurality of plate packages has a depiction that is different from the depictions on others of said top plates.

ALTERNATIVE EMBODIMENT B18

B18. The case of alternative embodiment B12, wherein depictions correspond to an animal theme.

ALTERNATIVE EMBODIMENT B19

B19. The case of alternative embodiment B12, wherein each plate has a main compartment depicting a primary attribute of an animal corresponding to said animal theme and at least two independent wells adjacent to said main compartment, each of said wells being shaped to depict a secondary attribute of said animal corresponding to said animal theme.

ALTERNATIVE EMBODIMENT B20

B20. The case of alternative embodiment B19 wherein the plurality of nestable plates include a first plate depicting a first animal and a second plate depicting a second animal that is different from said first animal, said secondary attribute within said wells of said first plate being a first physical feature of said first animal and said secondary attribute within said wells of said second plate being a second physical feature of said second animal, said first physical feature being different from said second physical feature while said wells of said first and second plates are similarly shaped to allow said plurality of plates to be nestable.

ALTERNATIVE EMBODIMENT B21

B21. The case of alternative embodiment B20, wherein said primary attributes of said first plate and said second plate include facial parts.

ALTERNATIVE EMBODIMENT B22

B22. The case of alternative embodiment B20, wherein said secondary attribute of said first plate is ears and said secondary attribute of said second plate is feet or claws.

ALTERNATIVE EMBODIMENT B23

B23. The case of alternative embodiment B20, wherein said secondary attribute of said first plate is fish fins and said secondary attribute of said second plate is eyes.

ALTERNATIVE EMBODIMENT B24

B24. The case of alternative embodiment B20, wherein said first animal and said second animal are selected from the group consisting of fish, sheep, whales, birds, horses, zebras, frogs, turtles, tigers, cats, and dogs.

ALTERNATIVE EMBODIMENT B25

B25. The case of alternative embodiment B19, wherein said wells are rounded.

ALTERNATIVE EMBODIMENT B26

B26. The case of alternative embodiment B19, wherein said main compartment is generally circular in shape.

ALTERNATIVE EMBODIMENT B27

B27. The case of alternative embodiment B19, wherein said wells extend outwardly from a portion of a periphery of said plate that defines said main compartment.

ALTERNATIVE EMBODIMENT B28

B28. An arrangement of cases for shipment to a certain retail destination, comprising:

a plurality of cases, each case including a plurality of plate packages, each plate package being individually purchasable by a retail consumer and including a plurality of nestable plates with at least some of said plurality of nestable plates including depictions associated with a common theme, at least one of said plurality of cases including plates having depictions that are different from plates located within other ones of said plurality of cases; and a structure for holding said plurality of cases relative to each other during shipping.

ALTERNATIVE EMBODIMENT B29

B29. The arrangement of cases of alternative embodiment B28, wherein said structure includes a shrink-wrap material.

ALTERNATIVE EMBODIMENT B30

B30. The arrangement of cases of alternative embodiment B28, wherein said structure includes a pallet on which said plurality of cases are stacked.

ALTERNATIVE EMBODIMENT B31

B31. The arrangement of cases of alternative embodiment B30, wherein said structure further includes a shrink-wrap material.

ALTERNATIVE EMBODIMENT B32

B32. The arrangement of cases of alternative embodiment B28, wherein said plurality of nestable plates within said plate packages are produced on at least a first manufacturing line and second manufacturing line, said first manufacturing line producing plates with a first array of depictions and said second manufacturing line producing plates with a second array of depictions that is different from said first array of depictions, said plurality of cases including cases that are comprised of plates from only said first manufacturing line and cases that are comprised of plates from only said second manufacturing line.

ALTERNATIVE EMBODIMENT B33

B33. The arrangement of cases of alternative embodiment B28, wherein each of said plurality of cases includes plates having depictions associated with said common theme.

ALTERNATIVE EMBODIMENT B34

B34. The arrangement of cases of alternative embodiment B33, wherein each plate within each of said plurality of plate packages includes depictions associated with said common theme.

ALTERNATIVE EMBODIMENT B35

B35. A method of developing cases containing similar containers for retail distribution, each case having containers with a variety of different depictions for enhanced consumer reception, comprising:

producing a plurality of containers on at least first and second manufacturing lines, said first manufacturing line including a print cylinder system capable of providing a first array of different depictions for a first set of containers within said plurality of containers, said second manufacturing line including a print cylinder system capable of providing a second array of different depictions for a second set of containers within said plurality of containers, said first array of different depictions including depictions that are different from depictions within said second array of different depictions;

accumulating said plurality of containers from said first manufacturing line in a first common location;

accumulating said plurality of containers from said second manufacturing line in a second common location;

at said first common location, selecting from containers having said first array of different depictions to form a first grouping of containers;

at said second common location, selecting from containers having said second array of different depictions to form a second grouping of containers;

packaging said first grouping of containers;

packaging said second grouping of containers; and forming a case of packaged containers that includes said first grouping of containers and said second grouping of containers.

ALTERNATIVE EMBODIMENT B36

B36. The method of alternative embodiment B35, wherein each packaged container includes a top container, a top container in one of said package containers having a different depiction than said top containers in others of said package containers within said case.

ALTERNATIVE EMBODIMENT B37

B37. A method of alternative embodiment B35, wherein said steps of selecting and packaging are performed multiple times to produce a plurality of said first grouping of containers and a plurality of said second grouping of containers, said step of forming said case including selecting various ones of said plurality of first grouping of containers and various ones of said plurality of second grouping of containers.

ALTERNATIVE EMBODIMENT B38

B38. The method of alternative embodiment B37, wherein containers within a certain grouping of said plurality of first grouping of containers include different depictions than containers in other groupings of said plurality of first groupings of containers, and containers within a certain grouping of said plurality of second groupings of containers include different depictions than containers in other groupings of said plurality of second groupings of containers.

ALTERNATIVE EMBODIMENT B39

B39. A method of packaging an arrangement of plates, comprising:

producing a plurality of plates from paperboard material, said paperboard material including a first array of depictions that include different depictions and a second array of depictions that include different depictions, said first array of depictions including depictions that are different from depictions within said second array of different depictions, said first array of depictions and said second array of depictions including depictions that are associated with a common theme;

selecting from plates having depictions from said first array of depictions to form a first group of plates;

selecting from plates having depictions from said second array of depictions to form a second group of plates;

placing a package around said first group of plates; and placing a package around said second group of plates.

ALTERNATIVE EMBODIMENT B40

B40. The method of alternative embodiment B39, wherein said first array of depictions is placed on a first web of material, and said second array of depictions is placed on a second web of material.

ALTERNATIVE EMBODIMENT B41

B41. The method of alternative embodiment B40, wherein said first array of depictions has different color combinations than said second array of depictions.

Alternative Embodiment B42

B42. The method of alternative embodiment B39, wherein said first array of depictions has different color combinations than said second array of depictions.

ALTERNATIVE EMBODIMENT B43

B43. The method of alternative embodiment B39, wherein some of said depictions in said first and second arrays are identical.

ALTERNATIVE EMBODIMENT B44

B44. The method of alternative embodiment B39, wherein all depictions in said first and second arrays of depictions are associated with said common theme.

ALTERNATIVE EMBODIMENT B45

B45. The method of alternative embodiment B39, wherein said steps of selecting include, respectively, selecting a top plate for said first group and selecting a top plate for said second group, said top plate for said first group having a different depiction than said top plate in said second group.

ALTERNATIVE EMBODIMENT B46

B46. The method of alternative embodiment B39, further including placing said packaged first group and said packaged second group in a common case for commercial distribution.

ALTERNATIVE EMBODIMENT B47

B47. The method of alternative embodiment B46, wherein said steps of selecting include, respectively, selecting a top plate for said first group and selecting a top plate for said second group, said top plate for said first group having a different depiction than said top plate in said second group

ALTERNATIVE EMBODIMENT B48

B48 The method of alternative embodiment B47, wherein said first array of depictions have different color combinations than said second array of depictions.

ALTERNATIVE EMBODIMENT B49

B49. The method of alternative embodiment B47, wherein said common theme is an animal theme.

ALTERNATIVE EMBODIMENT B50

B50 The method of alternative embodiment B47, wherein said common theme is a commonly known societal holiday.

ALTERNATIVE EMBODIMENT B51

B51. The method of alternative embodiment B47, wherein said common theme is vehicles

ALTERNATIVE EMBODIMENT B52

B52. The method of alternative embodiment B47, wherein said common theme is a sports theme.

ALTERNATIVE EMBODIMENT B53

B53. The method of alternative embodiment B47, wherein said plurality of plates include a number "n1" of different depictions, said number "n1" being greater than a number "n2" of plates in said first and second groups.

ALTERNATIVE EMBODIMENT B54

B54. The method of alternative embodiment B47, wherein each of said first and second groups includes a greater number of plates with different depictions than a number of plates that repeat the same depiction.

Alternative Embodiment B55

B55 The method of alternative embodiment B39, wherein said plurality of plates include a number "n1" of different depictions, said number "n1" being greater than a number "n2" of plates in said first and second groups.

ALTERNATIVE EMBODIMENT B56

B56. The method of alternative embodiment B39, wherein each of said first and second groups includes a greater number of plates with different depictions than a number of plates that repeat the same depiction.

ALTERNATIVE EMBODIMENT B57

B57. The method of alternative embodiment B39, wherein said steps of selecting are manual Alternative Embodiment B58

B58. The method of alternative embodiment B39, wherein said steps of selecting are automated.

While the invention is susceptible to various modifications and alternative forms, specific embodiments thereof have been shown by way of example in the drawings and herein described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

What is claimed is:

1. A method of packaging an arrangement of plates, comprising:

providing a plurality of plates, plates within said plurality of plates having a depiction associated with a common theme, said plurality of plates including a number "n1" of different depictions;

selecting from said plurality of plates to form a first group of plates, said first group of plates including plates having a variety of different depictions, selecting from said plurality of plates to form a second group of plates, said second group of plates including plates having a variety of different depictions, said second group of plates containing plates with different depictions than said first group of plates;

packaging said first group of plates for commercial distribution; and packaging said second group of plates for commercial distribution;

wherein said first and second groups of plates each include a number "n2" of plates, said number "n1" of different depictions being greater than said number "n2" of plates in said first and second groups.

2. The method of claim 1, wherein said first group of plates includes depictions that are not present within said second group of plates.

3. The method of claim 1, wherein selecting to form said first group and selecting to form said second group are performed automatically.

4. The method of claim 1, wherein selecting to form said first group occurs prior to selecting to form said second group.

5. The method of claim 4, wherein packaging said first group occurs prior to packaging of said second group.

6. The method of claim 1, wherein said first group is defined by several subgroups and said second group is defined by several subgroups, at least one subgroup from said first group having the same constituent plates as one subgroup from said second group.

7. The method of claim 1, wherein selecting to form said first group and selecting to form said second group include, respectively, selecting a top plate for said first group and selecting a top plate for said second group, said top plate for said first group having a different depiction than said top plate for said second group.

8. The method of claim 7, wherein selecting to form said first group and selecting to form said second group further include, respectively, excluding certain plates of said plurality of plates for consideration as said top plate on the basis of a type of depiction thereon.

9. The method of claim 1, wherein each of said plates within said plurality of plates has at least one depiction associated with said common theme.

10. The method of claim 1, wherein selecting to form said first group and selecting to form said second group include selecting from a plurality of subgroups to create said first and second groups of plates, each subgroup of said plurality of subgroups including a repeating pattern of plates.

11. The method of claim 10, wherein selecting to form said first group and selecting to form said second group are performed automatically.

12. The method of claim 10, wherein selecting to form said first group and selecting to form said second group are performed manually.

13. The method of claim 1, wherein each of said first and second groups of plates includes a greater number of different depictions than a number of repeats of the same depiction.

14. The method of claim 1, wherein providing includes creating said plurality of plates from a web of paperboard.

15. The method of claim 14, wherein creating includes printing an array of depictions on said web and cutting said array of depictions into said plurality of plates.

16. The method of claim 15, wherein cutting said array of depictions includes press-forming said plurality of plates.

17. The method of claim 1, wherein providing said plurality of plates includes creating plates from at least two webs of paperboard, a first web of paperboard being passed through a printing cylinder system for producing a first series of color combinations, a second web of paperboard being passed through a different printing cylinder system for producing a second series of color combinations that is different from said first series of color combinations, a portion of said different depictions being created only on said first web.

18. The method of claim 17, wherein a second portion of said different depictions is created only on said second web.

19. The method of claim 1, wherein selecting to form said first group and selecting to form said second group are performed at least partially manually.

20. A method of packaging an arrangement of containers for foods or beverages, comprising:

providing a plurality of containers, each container within said plurality of containers having a depiction associated with a common theme, said plurality of containers including a number "n1" of different depictions;

selecting from said plurality of containers to form a first group of containers, said first group of containers including a plurality of different depictions;

selecting from said plurality of containers to form a second group of containers, said second group of containers including a plurality of different depictions, said second group of containers containing containers with different depictions than said first group of containers;

packaging said first group of containers for commercial distribution; and packaging said second group of containers for commercial distribution;

wherein said first group of containers and said second group of containers each includes a number "n2" of containers, said number "n1" of different depictions being greater than said number "n2" of containers in said first group and said second group.

21. The method of claim 20, wherein said containers include plates.

22. The method of claim 20, wherein said containers include cups.

23. The method of claim 20, wherein said containers include bowls.

24. The method of claim 20, wherein selecting to form said first group of containers and selecting to form said second group of containers are performed automatically.

25. The method of claim 20, wherein selecting to form said first group of containers and selecting to form said second group of containers are performed at least partially manually.

26. The method of claim 20, wherein selecting to form said first group of containers and selecting to form said second group of containers include selecting from a plurality of subgroups to create said first and second groups of containers, each subgroup of said plurality of subgroups including a repeating pattern of containers.

27. The method of claim 20, wherein selecting to form said first group of containers and selecting to form said second group of containers include, respectively, selecting a top container for said first group and selecting a top container for said second group, said top container for said first group having a different depiction than said top container for said second group.

28. The method of claim 27, wherein selecting to form said first group of containers and selecting to form said second group of containers include, respectively, excluding certain containers of said plurality of containers for consideration as said top container on the basis of a type of depiction thereon.

29. The method of claim 20, wherein said common theme is an animal theme.

30. A method of packaging an arrangement of plates, comprising:

providing a plurality of plates, each plate within said plurality of plates having a depiction, said plurality of plates including a number "n1" of different depictions;

selecting from said plurality of plates to form a first group of plates;

selecting from said plurality of plates to form a second group of plates, said second group of plates having plates in a different order than said first group of plates such that said depictions on said plates of said first group are in a different order than said depictions on said plates of said second group;

packaging said first group of plates for commercial distribution; and packaging said second group of plates for commercial distribution, wherein said first group of plates and said second group of plates each includes a number "n2" of plates, said number "n1" of different depictions being greater than said number "n2" of plates in said first group and said second group.

31. The method of claim 30, wherein each of said plates within said plurality of plates has at least one depiction associated with a common theme.

32. The method of claim 30, wherein selecting to form said first group of plates and selecting to form said second group of plates include selecting from a plurality of subgroups to create said first and second groups, each subgroup of said plurality of subgroups including a repeating pattern of containers.

33. The method of claim 30, wherein selecting to form said first group of plates and selecting to form said second group of plates include, respectively, selecting a top plate for said first group and selecting a top plate for said second group, said top container for said first group having a different depiction than said top container for said second group.

34. The method of claim 33, wherein selecting to form said first group of plates and selecting to form said second group of plates are performed at least partially manually.

35. The method of claim 30, wherein said different depictions all have a common theme.

36. A method of packaging an arrangement of containers, comprising:

providing a plurality of containers, containers within said plurality of containers having a message associated with a common theme, said plurality of containers including a number "n1" of different messages;

selecting from said plurality of containers to form a first group of containers, said first group of containers having a variety of different messages;

selecting from said plurality of containers to form a second group of containers, said second group of containers having a variety of different messages, said second group of containers having containers with different messages than said first group of containers;

packaging said first group of containers; and packaging said second group of containers;

wherein said first group of containers and said second group of containers each includes a number "n2" of containers, said number "n1" of different messages being greater than said number "n2" of containers in said first group and said second group.

37. The method of claim 36, wherein said common theme is a commonly known societal holiday.

38. The method of claim 36, wherein said commonly known societal holiday is Valentine's day and said messages include messages suggesting romance.

39. The method of claim 36, wherein said messages include entertainment trivia.

40. The method of claim 36, wherein said messages include educational trivia and said containers include depictions associated with said educational trivia.

41. The method of claim 40, wherein said depictions include animals and said educational trivia includes trivia associated with said animals.

* * * * *

UNITED STATES PATENT AND TRADEMARK OFFICE

CERTIFICATE OF CORRECTION

PATENT NO. : 7,013,618 B2
DATED : March 21, 2006
INVENTOR(S) : Schiltz et al.

It is certified that error appears in the above-identified patent and that said Letters Patent is hereby corrected as shown below:

Title page,
Item [56], References Cited, U.S. PATENT DOCUMENTS,
change "1,502,402" to -- 1,520,402 --.

Column 28,
Line 1, after "providing a plurality of plates," delete "plates" and insert -- each plate --.
Line 31, after "group occurs prior to packaging" delete "of".

Column 31,
Line 10, after "The method of claim" delete "36" and insert -- 37 --.

Signed and Sealed this

Sixth Day of June, 2006

JON W. DUDAS
*Director of the United States Patent and Trademark Office*